US011488771B2

(12) United States Patent
Chou et al.

(10) Patent No.: US 11,488,771 B2
(45) Date of Patent: Nov. 1, 2022

(54) ADAPTER AND TRANSFORMER THEREOF

(71) Applicant: Chicony Power Technology Co., Ltd., New Taipei (TW)

(72) Inventors: Po-Chien Chou, New Taipei (TW); Che-Shih Lin, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 420 days.

(21) Appl. No.: 16/748,819

(22) Filed: Jan. 22, 2020

(65) Prior Publication Data

US 2020/0161043 A1 May 21, 2020

Related U.S. Application Data

(63) Continuation-in-part of application No. 15/725,256, filed on Oct. 4, 2017, now abandoned.

(30) Foreign Application Priority Data

Jul. 28, 2017 (TW) ..... 106125614
Aug. 22, 2017 (TW) ..... 106128489

(51) Int. Cl.
*H01F 5/02* (2006.01)
*H01F 27/32* (2006.01)
(Continued)

(52) U.S. Cl.
CPC ..... *H01F 27/325* (2013.01); *H01F 5/02* (2013.01); *H01F 27/289* (2013.01); *H01F 2027/065* (2013.01)

(58) Field of Classification Search
CPC .... H01F 27/325; H01F 5/02; H01F 2005/022; H01F 2005/025; H01F 2005/046;
(Continued)

(56) References Cited

U.S. PATENT DOCUMENTS

2011/0260820 A1* 10/2011 Liao ..... H01F 27/325 336/192
2014/0240073 A1* 8/2014 Yen ..... H01F 5/04 336/208
(Continued)

FOREIGN PATENT DOCUMENTS

CN 101923935 A 12/2010
CN 102194569 A 9/2011
(Continued)

OTHER PUBLICATIONS

Office Action dated Aug. 4, 2020 of the corresponding China patent application No. 201710784554.9.

*Primary Examiner* — Mang Tin Bik Lian
*Assistant Examiner* — Mangtin Lian
(74) *Attorney, Agent, or Firm* — Chun-Ming Shih; HDLS IPR Services

(57) ABSTRACT

An adapter is provided and having a circuit board, primary components and secondary components installed on the circuit board, a shielding plate disposed between the primary components and the secondary components, and a transformer installed on the circuit board. The transformer has a bobbin, an iron core set assembled with the bobbin, at least one movable pin, at least one first winding, and at least one second winding. The movable pin is able to be positioned at an upper position for allowing the iron core set to be assembled with the bobbin or for allowing the first winding and the second winding to be wound onto the winding portion, and the movable pin is able to be positioned at a lower position when the transformer is installed onto the circuit board. Thereby, the adapter can be assembled in an automated process with improved assembly efficiency and high production yields.

17 Claims, 23 Drawing Sheets

(51) Int. Cl.
*H01F 27/28* (2006.01)
*H01F 27/06* (2006.01)

(58) Field of Classification Search
CPC .. H01F 27/289; H01F 2027/065; H01F 27/06; H01F 2027/297; H01F 27/2828; H01F 27/292; H01F 5/04
See application file for complete search history.

(56) References Cited

U.S. PATENT DOCUMENTS

2014/0375409 A1* 12/2014 Peng ..... H01F 27/325
336/198
2015/0279547 A1* 10/2015 Park ..... H05K 1/165
336/200

FOREIGN PATENT DOCUMENTS

CN 104240918 A 12/2014
CN 104979071 A 10/2015
CN 205248110 U 5/2016
CN 106683854 A 5/2017
CN 207319880 U 5/2018

* cited by examiner

ADAPTER AND TRANSFORMER THEREOF

CROSS-REFERENCE TO RELATED APPLICATION

This application is a Continuation-in-Part of co-pending application Ser. No. 15/725,256, filed on Oct. 4, 2017. The entire disclosure is incorporated herein by reference.

TECHNICAL FIELD

The present invention relates to a transformer structure and, in particular, to an adapter having the transformer.

BACKGROUND

In general, a transformer includes a bobbin, a magnetic core set, a primary winding and a secondary winding. The primary winding and the secondary winding are both constructed from multiloop single-core wires and commonly put one around another to form magnetically coupled coils. The primary winding and the secondary winding are wound around the bobbin and their outlets are usually disposed at respective two sides of the bobbin to create isolation. The magnetic core set is installed on the bobbin to surround the primary winding and the secondary winding. Generally, the phenomenon of electromagnetic induction of the magnetic core set creates a voltage at the secondary winding due to a voltage inputted from the primary winding, and then the voltage at the secondary winding is outputted to post-stage circuits to achieve increasing or decreasing the voltage originally inputted from the primary winding.

Generally, the transformer is assembled to an adapter by the following scheme. The adapter includes a circuit board and a current processing module. The current processing module is electrically connected to the circuit board. The current processing module includes a primary component and a secondary component. The transformer is assembled to the circuit board and is arranged between the primary component and the secondary component. The primary winding is electrically connected to the primary component, and the secondary winding is electrically connected to the secondary component. The primary component performs a preceding process on a current which would be inputted to the primary winding, and the secondary component performs a subsequent process on a current which is outputted from the secondary winding.

However, the adapter and the transformer mentioned above have the following disadvantages. Commonly, an end of the primary winding is directly welded to the circuit board. At present, the adapter is usually downsized due to the miniaturization trends of electronic products. Therefore, the primary component has become much closer to the secondary component, leading to a reduced space for welding the secondary winding. As a result, welding the secondary winding to the circuit board must be done manually, and no automated production process can be adopted for the assembly. This causes higher labor costs, lesser assembly efficiency and lower production yields.

In views of this, in order to solve the above-mentioned disadvantages, the present inventor studied related technology and provided a reasonable and effective solution in the present disclosure.

SUMMARY

The present disclosure provides an adapter including a circuit board, a current processing module, a shielding plate and a transformer. The current processing module includes a plurality of primary components and a plurality of secondary components installed and electrically connected to the circuit board. The shielding plate is disposed between the primary components and the secondary components. The transformer is installed on the circuit board, and the transformer includes a bobbin, an iron core set, at least one movable pin, and at least one first winding. The bobbin is disposed on one side of the shielding plate. The bobbin includes two side walls and a winding portion arranged between the two side walls, a protruding plate extending from one of the side walls and disposed across the shielding plate, at least one through hole is defined on the protruding plate and a connection pin arranged on the other side wall, and the connection pin is inserted into the circuit board. The iron core set is assembled with the bobbin. The movable pin includes a first latch portion and a second latch portion, the movable pin is movably disposed in the through hole, the second latch portion is disposed above the first latch portion, the movable pin is disposed on one side of the iron core set, the first latch portion is a first pattern formed on the movable pin, and the second latch portion is a second pattern formed on the movable pin, the largest width of the first pattern is larger than a diameter of the through hole, and the largest width of the second pattern is larger than the diameter of the through hole. The first winding is wound around the winding portion and electrically connected to the connection pin. The second winding is wound around the winding portion and electrically connected to the movable pin. The movable pin is selectively positioned at one of an upper position and a lower position, the movable pin is positioned at the upper position by tightly fitting the first pattern in the through hole for allowing the iron core set to be assembled with the bobbin or for allowing the first winding and the second winding to be wound onto the winding portion, and the movable pin is positioned at the lower position by tightly fitting the second pattern in the through hole when the transformer is installed onto the circuit board.

According to the adapter of the present disclosure, a channel communicating with an inside of the winding portion passes through the two side walls, the channel is arranged below the protruding plate, a portion of the iron core set is inserted and engaged inside the channel, and another portion of the iron core set surrounds the exterior of the winding portion. The circuit board is divided into a primary area and a secondary area, the shielding plate is disposed on the circuit board and is disposed between the primary area and the secondary area, the primary components and the connection pin are installed and electrically connected to the primary area, and the secondary components and the movable pin are installed and electrically connected to the secondary area. The shielding plate includes a recess indented from a top of the shielding plate, and the protruding plate is engaged with the recess. A wiring groove is disposed on a top of the protruding plate and arranged in a direction from the winding portion toward the through hole, two guiding blocks extend from the top of the protruding plate, and the wiring groove is formed between the two guiding blocks. An assembling slot corresponding to the shielding plate is defined on the circuit board, the shielding plate is inserted through the assembling slot from a bottom surface of the circuit board. A base is extended from a bottom of the shielding plate along a lateral direction of the shielding plate, and the bottom surface of the circuit board is at least partially covered by the base. The first pattern and the second pattern are respectively made by punching on parts of a lateral surface of the movable pin to cause protruding deformation at other adjacent parts of the lateral surface of the movable pin. The first pattern and the second pattern are respective rough surfaces made by texture process.

The present disclosure further provides a transformer suitable for an adapter. The transformer includes a bobbin, an iron core set and at least one movable pin. The bobbin includes two side walls and a winding portion arranged between the two side walls, a protruding plate extending from one of the side walls, at least one through hole is defined on the protruding plate and a connection pin arranged on the other side wall. The iron core set is assembled with the bobbin. The movable pin includes a first latch portion and a second latch portion, the movable pin is movably disposed in the through hole, the second latch portion is disposed above the first latch portion, the movable pin is disposed on one side of the iron core set, the first latch portion is a first pattern formed on the movable pin, and the second latch portion is a second pattern formed on the movable pin, the largest width of the first pattern is larger than a diameter of the through hole, and the largest width of the second pattern is larger than the diameter of the through hole. The first winding is wound around the winding portion and electrically connected to the connection pin. The second winding wound around the winding portion and electrically connected to the movable pin. The movable pin is selectively positioned at one of an upper position and a lower position, the movable pin is positioned at the upper position by tightly fitting the first pattern in the through hole for allowing the iron core set to be assembled with the bobbin or for allowing the first winding and the second winding to be wound onto the winding portion, and the movable pin is positioned at the lower position by tightly fitting the second pattern in the through hole when the transformer is installed onto the adapter.

According to the transformer of the present disclosure, a channel communicating with an inside of the winding portion passes through the two side walls, the channel is arranged below the protruding plate, a portion of the iron core set is inserted and engaged inside the channel, and another portion of the iron core set surrounds the exterior of the winding portion. A wiring groove is disposed on a top of the protruding plate and arranged in a direction from the winding portion toward the through hole, two guiding blocks extend from the top of the protruding plate, and the wiring groove is formed between the two guiding blocks. The first pattern and the second pattern are respectively made by punching on parts of a lateral surface of the movable pin to cause protruding deformation at other adjacent parts of the lateral surface of the movable pin. The first pattern and the second pattern are respective rough surfaces made by texture process. An insulation cover at least partially wraps the iron core set. A stopping block is protrusively disposed on an external lateral surface of the insulation cover for positioning the transformer.

The present disclosure further provides another alternative transformer suitable for an adapter. The alternative transformer includes a bobbin, an iron core set, a first movable pin, a second movable pin, a first winding and a second winding. The bobbin includes a first side wall, a second side wall, and a winding portion arranged between the first side wall and the second side wall, a first protruding plate extending from the first side wall, a second protruding plate extending from the second side wall, a first through hole defined on the first protruding plate, and a second through hole defined on the second protruding plate. The iron core set is assembled with the bobbin. The first movable pin includes a first latch portion and a second latch portion, the first movable pin is movably disposed in the first through hole, the second latch portion is disposed above the first latch portion, the first movable pin is disposed on one side of the iron core set, the first latch portion is a first pattern formed on the first movable pin, and the second latch portion is a second pattern formed on the first movable pin, the largest width of the first pattern is larger than a diameter of the first through hole, and the largest width of the second pattern is larger than the diameter of the first through hole. The second movable pin includes a third latch portion and a fourth latch portion, the second movable pin is movably disposed in the second through hole, the fourth latch portion is disposed above the third latch portion, the second movable pin is disposed on another side of the iron core set, the third latch portion is a third pattern formed on the second movable pin, and the fourth latch portion is a fourth pattern formed on the second movable pin, the largest width of the third pattern is larger than a diameter of the second through hole, and the largest width of the fourth pattern is larger than the diameter of the second through hole. The first winding is wound around the winding portion and electrically connected to the first movable pin. The second winding is wound around the winding portion and electrically connected to the second movable pin. The first movable pin is selectively positioned at one of an upper position and a lower position, the first movable pin is positioned at the upper position by tightly fitting the first pattern in the first through hole for allowing the iron core set to be assembled with the bobbin or for allowing the first winding and the second winding to be wound onto the winding portion, and the first movable pin is positioned at the lower position by tightly fitting the second pattern in the first through hole when the transformer is installed onto the adapter. The second movable pin is selectively positioned at one of an upper position and a lower position, the second movable pin is positioned at the upper position by tightly fitting the third pattern in the second through hole for allowing the iron core set to be assembled with the bobbin or for allowing the first winding and the second winding to be wound onto the winding portion, and the second movable pin is positioned at the lower position by tightly fitting the fourth pattern in the second through hole when the transformer is installed onto the adapter.

To sum up, the movable pin is inserted into the through hole and is positioned therein by the engagement of the first latch portion or the second latch portion. The iron core set is assembled to the bobbin; the second winding is electrically connected to the movable pin by means of welding or adhesives. The transformer is installed on the circuit board, the bobbin is mainly disposed on the primary area, the protruding plate extends across the shielding plate to reach over the secondary area, the first latch portion deforms or is damaged to temporarily release the movable pin, and the movable pin is then inserted into the secondary area of the circuit board. Thus, the adapter and the transformer can be assembled in an automated process using robot arms to complete the above procedures. Through the automated process, labor costs of the adapter and the transformer are reduced, and assembly efficiency of the adapter and the transformer is enhanced, together with improved production yields.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
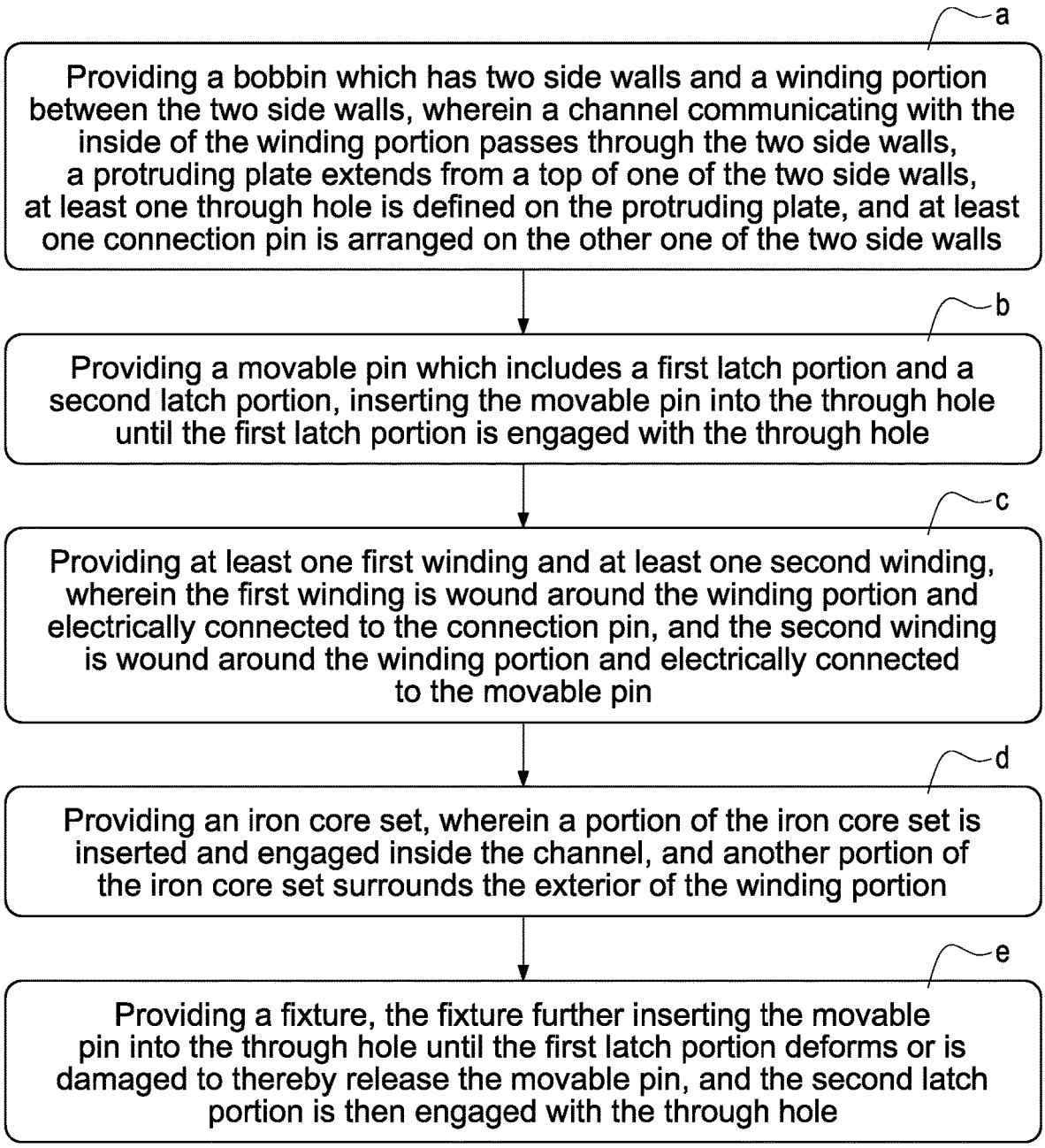
FIG. 1 is a diagram illustrating a process flow for an assembly method of a transformer according to the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 8, a first embodiment of the present invention provides an adapter, a transformer, and an assembly method of the transformer. The adapter 10 includes a circuit board 1, a current processing module 2, a shielding plate 3, and a transformer 4. The transformer 4 includes a bobbin 41, one or more movable pin 42, an iron core set 45, one or more first windings 43, and one or more second windings 44.

Figure 2:
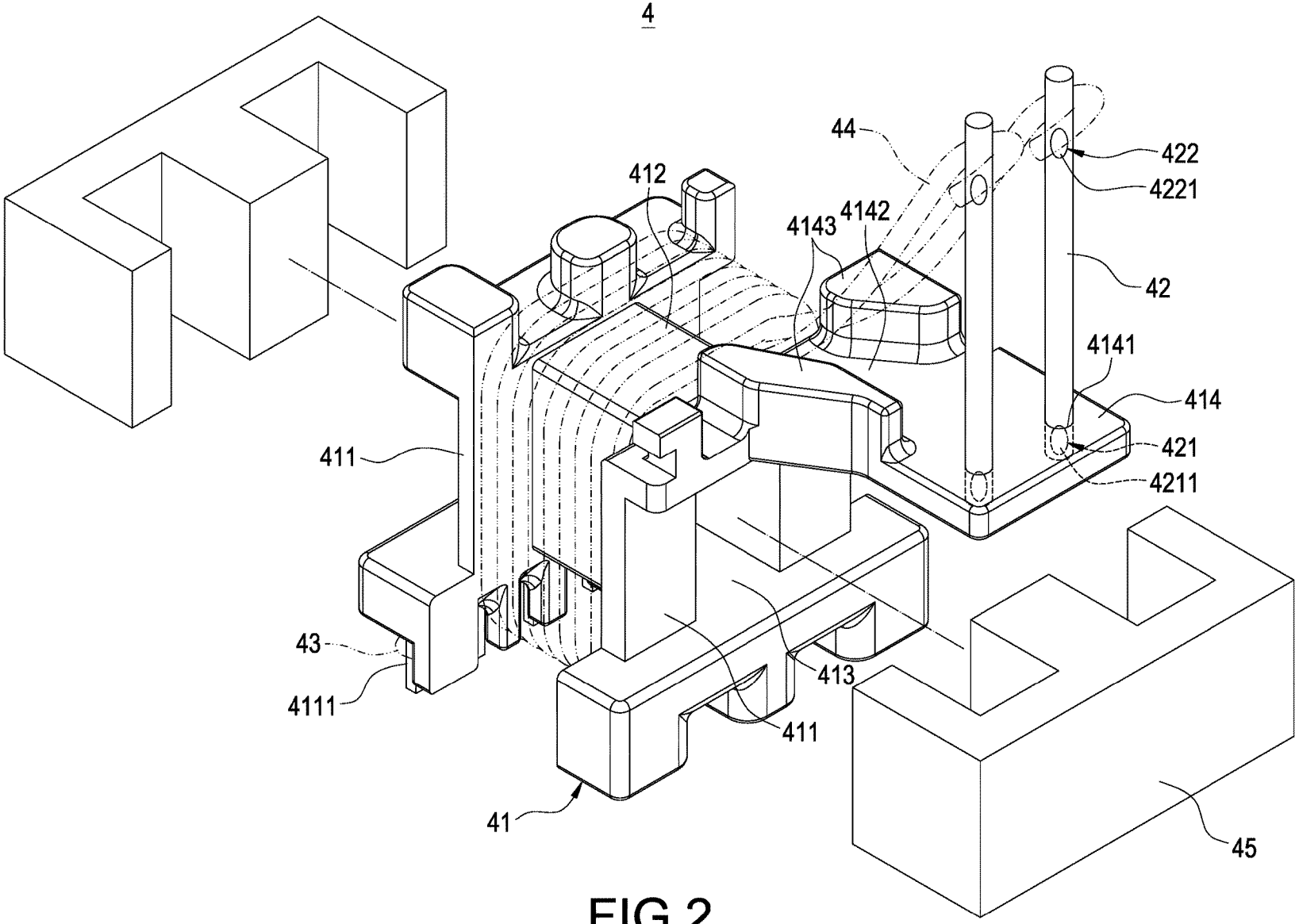
FIG. 2 is a schematic partial exploded view illustrating a portion of an iron core set of a transformer is about to be engaged in a channel according to the first embodiment of the present invention.

Please refer to FIG. 1 showing a process flow for an assembly method of the transformer 4, and FIG. 2 showing a portion of an iron core set of a transformer is about to be engaged in a channel. First, in step a of FIG. 1, as shown in FIG. 2, a bobbin 41 is provided. The bobbin 41 includes two side walls 411, and a winding portion 412 arranged between the two side walls 411. A channel 413 communicating with an inside of the winding portion 412 passes through the two side walls 411, and a protruding plate 414 extending from a top of one of the two side walls 411. That is to say, the channel 413 is arranged below the protruding plate 414. One or more through holes 4141 are defined on the protruding plate 414, and one or more connection pins 4111 are arranged on the other one of the two side walls 411.

In step b of FIG. 1, as shown in FIG. 2, one or more movable pins 42 are provided. The movable pin 42 includes a first latch portion 421 and a second latch portion 422. The movable pin 42 is movably inserted into the through hole 4141, until the first latch portion 421 is engaged and positioned in the through hole 4141.

In detail, in the present embodiment, the first latch portion 421 is a first pattern 4211 formed on the movable pin 42, and the second latch portion 422 is a second pattern 4221 formed on the movable pin 42. At least a part of the first pattern 4211 protrudes on a lateral surface of the movable pin 42, and at least a part of the second pattern 4221 protrudes on the lateral surface of the movable pin 42. Specifically, the first pattern 4211 and the second pattern 4221 could be respective rough surfaces made by a texture process in the first embodiment. In general, a width (or a diameter) of the movable pin 42 is substantially the same as the diameter of the through hole 4141. However, the width of the movable pin 42 varies at the first latch portion 421 and the second latch portion 422, so that the width (or the diameter) of the first latch portion 421 and the width of the second latch portion 422 are different from the diameter of the through hole 4141. Accordingly, the movable pin 42 is movably assembled into the through hole 4141 of the protruding plate 414. As an example, in the present embodiment, the largest width of the first pattern 4211 is larger than the diameter of the through hole 4141, and the largest width of the second pattern 4221 is larger than the diameter of the through hole 4141; however, the present embodiment is not limited in this regard. In other varied embodiments, the first latch portion 421 and the second latch portion 422 can be formed on the movable pin 42 by adhesive or protruding dots.

In step c of FIG. 1, as shown in FIG. 2, one or more first winding 43 and one or more second winding 44 are provided. The first winding 43 is wound around the winding portion 412 and is electrically connected to the connection pin 4111 by means of welding or adhesives, and the second winding 44 is wound around the winding portion 412 and is electrically connected to the movable pin 42 by means of welding or adhesives.

Figure 3:
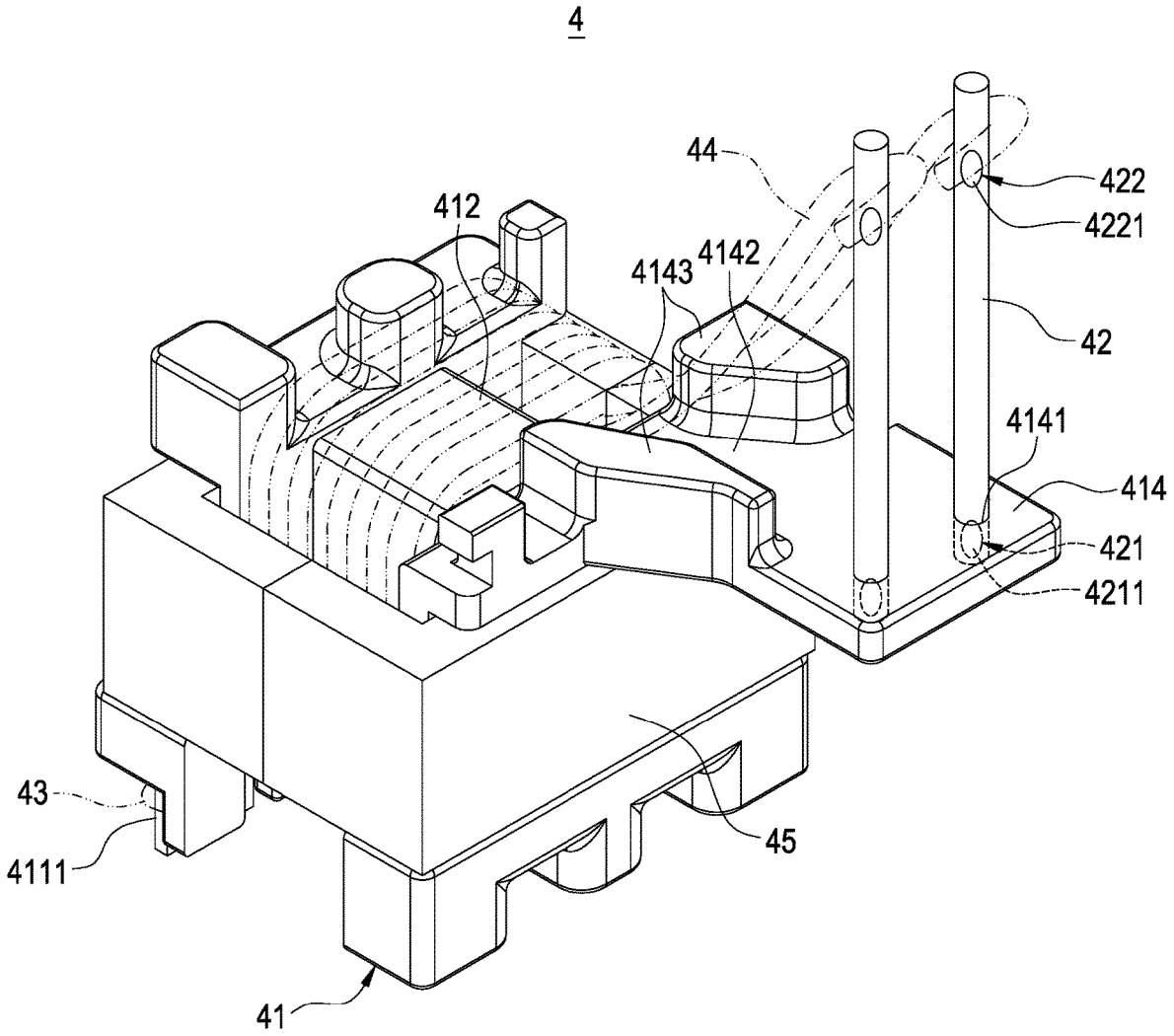
FIG. 3 is a schematic perspective view illustrating at least one movable pin of the transformer to be inserted into a through hole according to the first embodiment of the present invention.

In step d of FIG. 1, as shown in FIGS. 2 and 3, the iron core set 45 is provided and is assembled with the bobbin 41. A portion of the iron core set 45 is inserted and engaged inside the channel 413, and another portion of the iron core set 45 surrounds the exterior of the winding portion 412.

Figure 4:
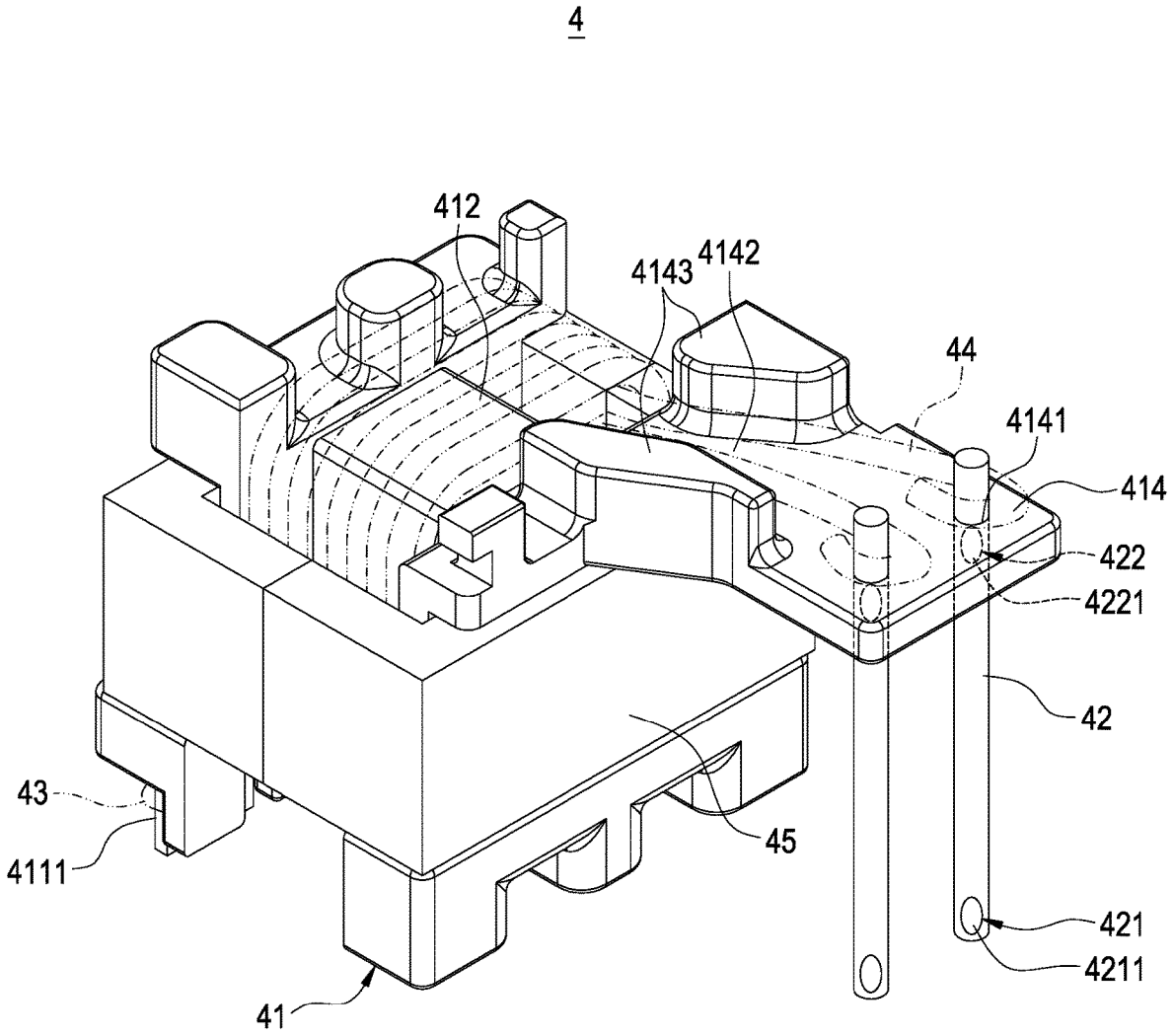
FIG. 4 is a schematic perspective view illustrating the finished transformer according to the first embodiment of the present invention.
Figure 5:
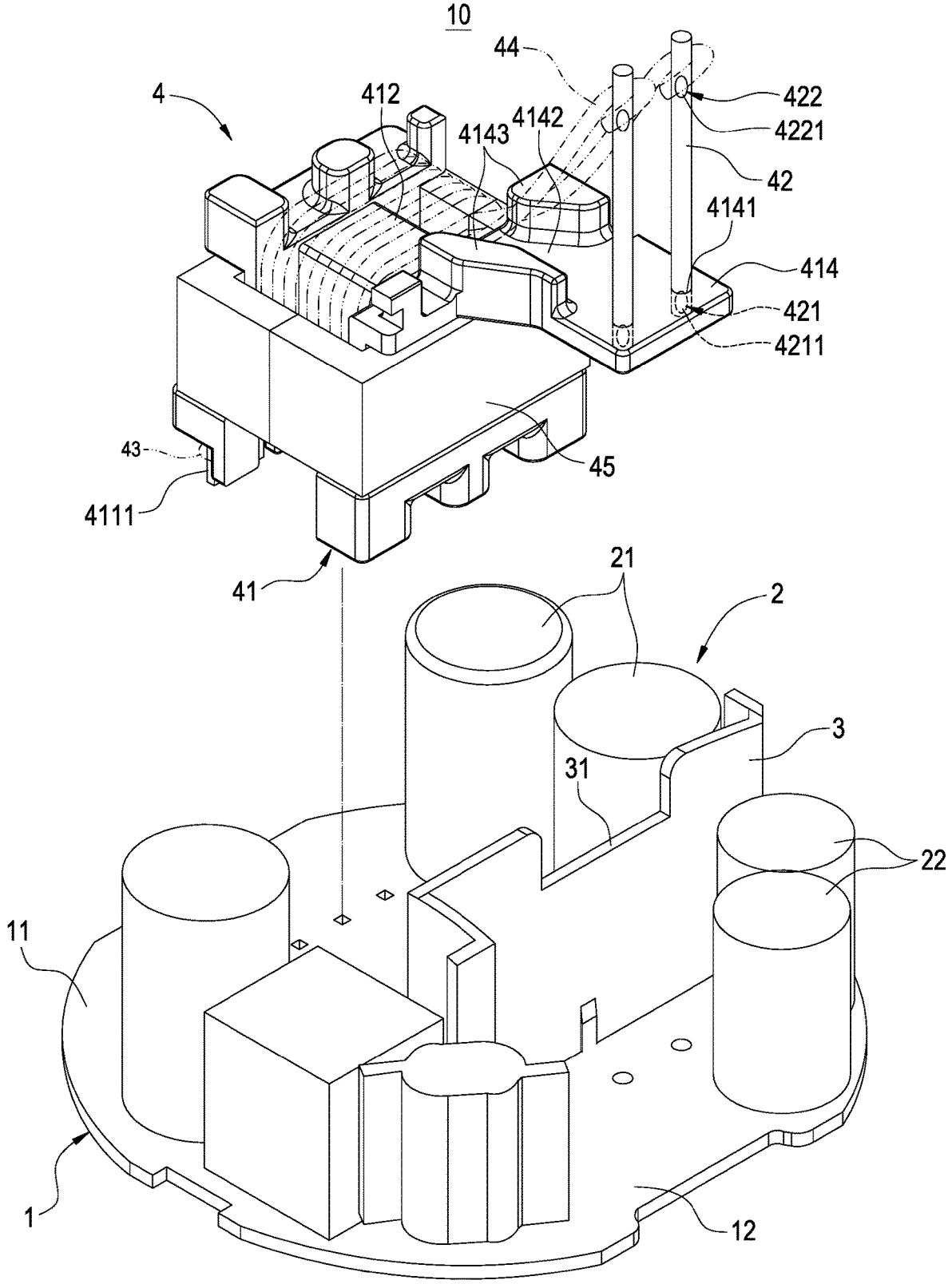
FIG. 5 is a schematic partial exploded view illustrating assembling of an adapter according to the first embodiment of the present invention.

In step e of FIG. 1, as shown in FIGS. 3 and 4, a fixture (not illustrated) is provided. The fixture further drives down the movable pin 42 and forces it continually moving through the through hole 4141 until the first latch portion 421 deforms or is damaged. At the moment, the first latch portion 421 is no longer engaged with the protruding plate 414 and thereby the movable pin 42 is released temporarily. Finally, the second latch portion 422 is then engaged with the through hole 4141.

Furthermore, as shown in FIGS. 2 to 4, a wiring groove 4142 is disposed on a top of the protruding plate 414 and arranged in a direction from the winding portion 412 toward the through hole 4141. Two guiding blocks 4143 extend from the top of the protruding plate 414, and the wiring groove 4142 is formed between the two guiding blocks 4143. The wiring groove 4142 is used to receive the second winding 44, so that the second winding 44 is confined between the two guiding blocks 4143.

Please refer to FIGS. 5 to 8, illustrating assembling of the adapter 10. First, the circuit board 1 is divided into a primary area 11 and a secondary area 12. The current processing module 2 includes a plurality of primary components 21 and a plurality of secondary components 22. The primary components 21 are installed in the primary area 11 and are electrically connected to the circuit board 1. The secondary components 22 are installed in the secondary area 12 and are electrically connected to the circuit board 1.

Furthermore, since the present adapter 10 is downsized due to the miniaturization trend of electronic product, the primary components 21 are close to the secondary components 22. Therefore, the shielding plate 3 is arranged on the circuit board 1 and between the primary area 11 and the secondary area 12. That is, the shielding plate 3 is arranged between the primary components 21 and the secondary components 22, and the shielding plate 3 separates the primary components 21 from the secondary components 22 to maintain a sufficient creepage distance and prevent the primary components 21 and the secondary components 22 from affecting each other during the operations of the adapter 10. The shielding plate 3 is made of plastic or other suitably insulating materials, and includes a recess 31 indented from a top of the shielding plate 3.

Moreover, the transformer 4 is installed on the circuit board 1, so that most part of the bobbin 41 is disposed on one side of the shielding plate 3 (on the primary area 11), and the protruding plate 414 is engaged with the recess 31 to make the protruding plate 414 extending across the shielding plate 3 and reaching over the secondary area 12.

Finally, the connection pin 4111 is inserted and electrically connected to the primary area 11, and the primary components 21 are electrically connected to the first winding 43 through the circuit board 1 and the connection pin 4111, so that the primary components 21 can process an input current from supply mains, and then can deliver a processed current to the first winding 43. The movable pin 42 is inserted through the through hole 4141, the movable pin 42 is inserted and electrically connected to the secondary area 12, and the secondary components 22 are electrically connected to the second winding 44 through the circuit board 1 and the movable pin 42, so that the secondary components 22 can perform a subsequent process on a current outputted from the second winding 44.

In the present embodiment, the first winding 43 and the connection pin 4111 are electrically connected to the primary components 21, so the first winding 43 is a primary winding, and the connection pin 4111 is a primary pin. The second winding 44 and the movable pin 42 are electrically connected to the secondary components 22, so the second winding 44 is a secondary winding, and the movable pin 42 is a secondary pin. However, the present invention is not limited to the embodiment disclosed. Configurations may be modified according to requirement. In other varied embodiments, the first winding 43 can be a secondary winding, and the connection pin 4111 can be a secondary pin; the second winding 44 can be a primary winding, and the movable pin 42 can be a primary pin.

Figure 8:
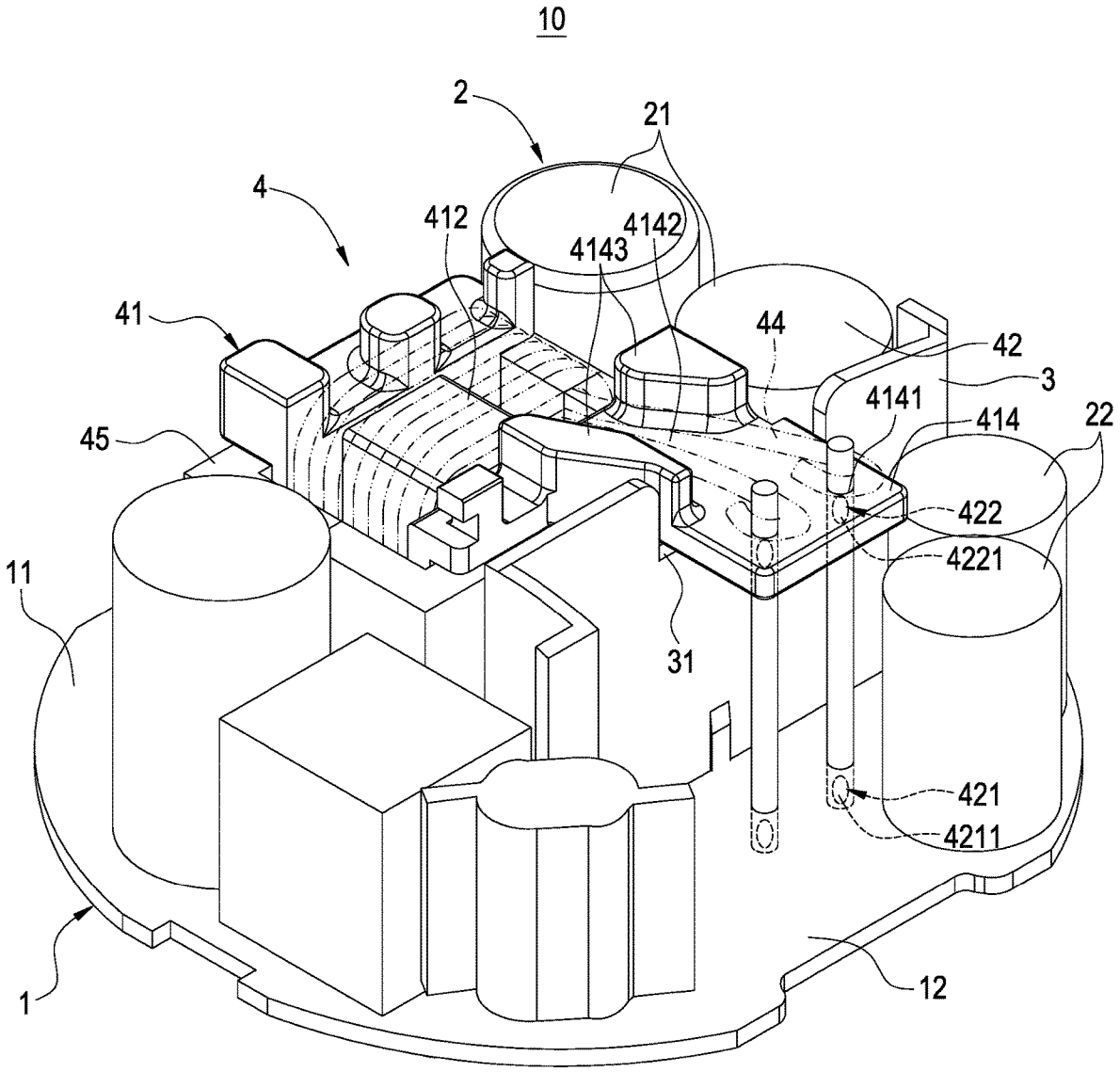
FIG. 8 is a schematic perspective view illustrating the finished adapter according to the first embodiment of the present invention.

Furthermore, as shown in FIGS. 4 and 8, since the second latch portion 422 is disposed above the first latch portion 421 and the movable pin 42 is disposed on one side of the iron core set 45 when the second latch portion 422 is engaged and positioned in the through hole 4141, the first latch portion 421 is arranged away from the protruding plate 414. In other words, the first latch portion 421 is arranged close to the circuit board 1.

In conventional techniques, a second winding is directly welded to a circuit board by manual manner. By contrast, the adapter 10 and the transformer 4 can be assembled in an automated process using robot arms to complete the following procedures. The movable pin 42 is inserted into the through hole 4141 and is positioned right still at the through hole 4141 through the engagement of the first latch portion 421. The iron core set 45 is assembled to the bobbin 41, and the second winding 44 is electrically connected to the movable pin 42 by means of welding or adhesives. The transformer 4 is installed on the circuit board 1, and the bobbin 41 is mainly disposed on the primary area 11. The protruding plate 414 extends across the shielding plate 3 to reach over the secondary area 12. Due to the fixture, the first latch portion 421 deforms or is damaged to temporarily release the movable pin 42, and the movable pin 42 is then inserted into the secondary area 12 of the circuit board 1. Thus, by the adopted automated process, the labor costs of the adapter 10 are reduced, and the assembly efficiency of the adapter 10 is enhanced, together with the improved production yields.

Furthermore, as shown in FIGS. 2 to 4, after the assembly of the transformer 4, the movable pin 42 is disposed on one side of the iron core set 45. If the movable pin 42 is fixed and immobile on one side of the iron core set 45 (as shown in FIG. 4) in the very beginning of the assembly of the transformer 4, it is not possible to install the iron core set 45 during assembling (because the unsettled iron core set 45 would be blocked by the "fixed" movable pin 42). Therefore, the movable pin 42 is designed to be movable and is positioned by means of the first latch portion 421 and the second latch portion 422 in sequence, so that the iron core set 45 can be installed without obstacles (according to the case of horizontal type transformers, as described in this embodiment). Additionally, in another embodiment of a vertical type transformer (see FIG. 9), if a movable pin is fixed and immobile on one side of an iron core set in the very beginning of the assembly of the transformer, it is not possible to wind a first winding and a second winding during assembling (because the unsettled windings would be blocked by the "fixed" movable pin). Therefore, the movable pin is designed to be movable and is positioned by similar means of a first latch portion and a second latch portion in sequence, so that the first winding and the second winding can be wound without blocks.

Figure 6:
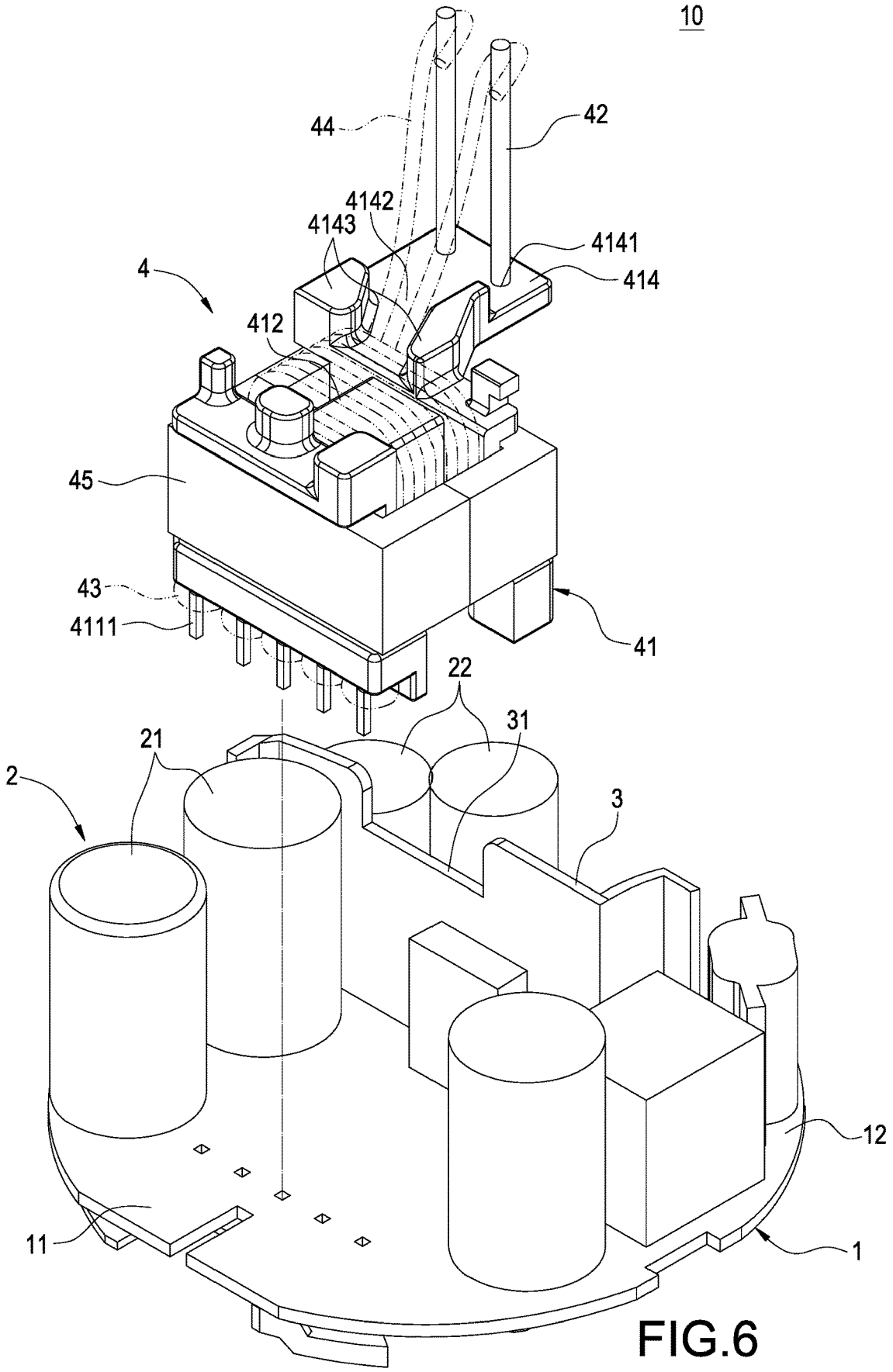
FIG. 6 is another schematic partial exploded view illustrating assembling of the adapter according to the first embodiment of the present invention.
Figure 7:
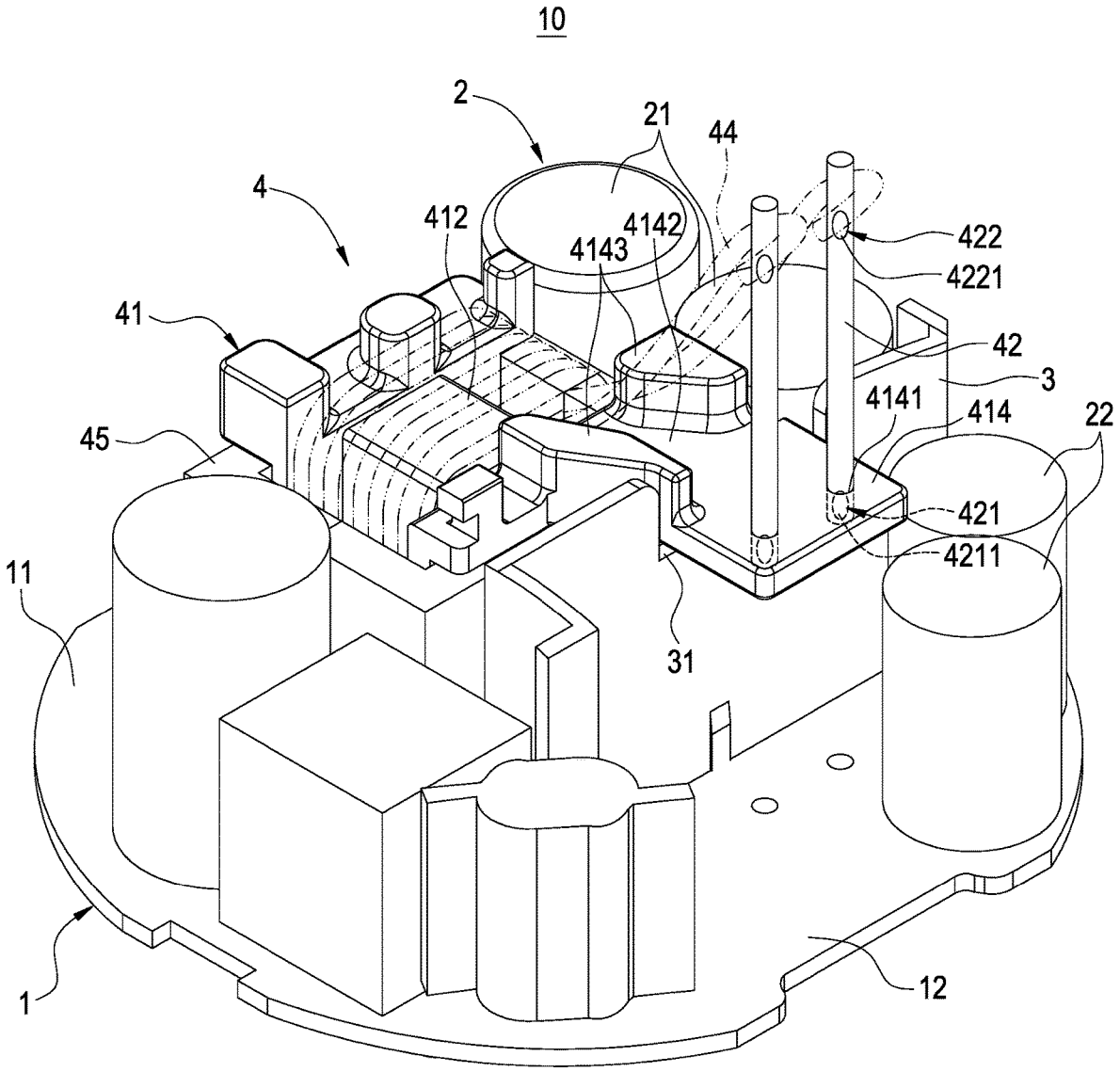
FIG. 7 is a schematic perspective view illustrating assembling of the adapter according to the first embodiment of the present invention.

Moreover, as shown in FIGS. 6 to 8, due to the miniaturization trend of electronic product, the adapter 10 is downsized, and as a result, the primary pin would become much more close to the secondary pin, which fails to provide a minimum insulation distance (e.g., creepage distance) to meet the safety regulations. Therefore, in order to provide a sufficient insulation distance as required by the safety regulations for the downsized adapter 10, the protruding plate 414 is arranged to increase an additional distance between the connection pin 4111 and the movable pin 42 of the transformer 4 (in which one of them is the primary pin and the other one is the secondary pin).

Moreover, in the above-mentioned embodiment, the movable pin 42 is disposed on only one side of the transformer 4 (e.g., the secondary side of the transformer 4). It should be noted that, in other varied embodiments, one movable pin 42 can be disposed on one side (e.g., a secondary side of a transformer) and another movable pin 42 can be disposed on the other side (e.g., a primary side of the transformer). Therefore, this modification is still within the protection scope of the present invention. In detail, as shown in FIGS. 2 to 4, in the present embodiment, although the connection pin 4111 is a fixed pin, the present invention is not limited to this particular form. That is, the connection pin 4111 can also be a movable-type pin in another embodiment (see FIG. 21). If there are two protruding plates extending from two side walls of a bobbin, respectively, a connection pin can also be a movable-type pin (similar to the structure of the movable pin 42), which is also inserted into a through hole defined on one of the two protruding plates.

Figure 9:
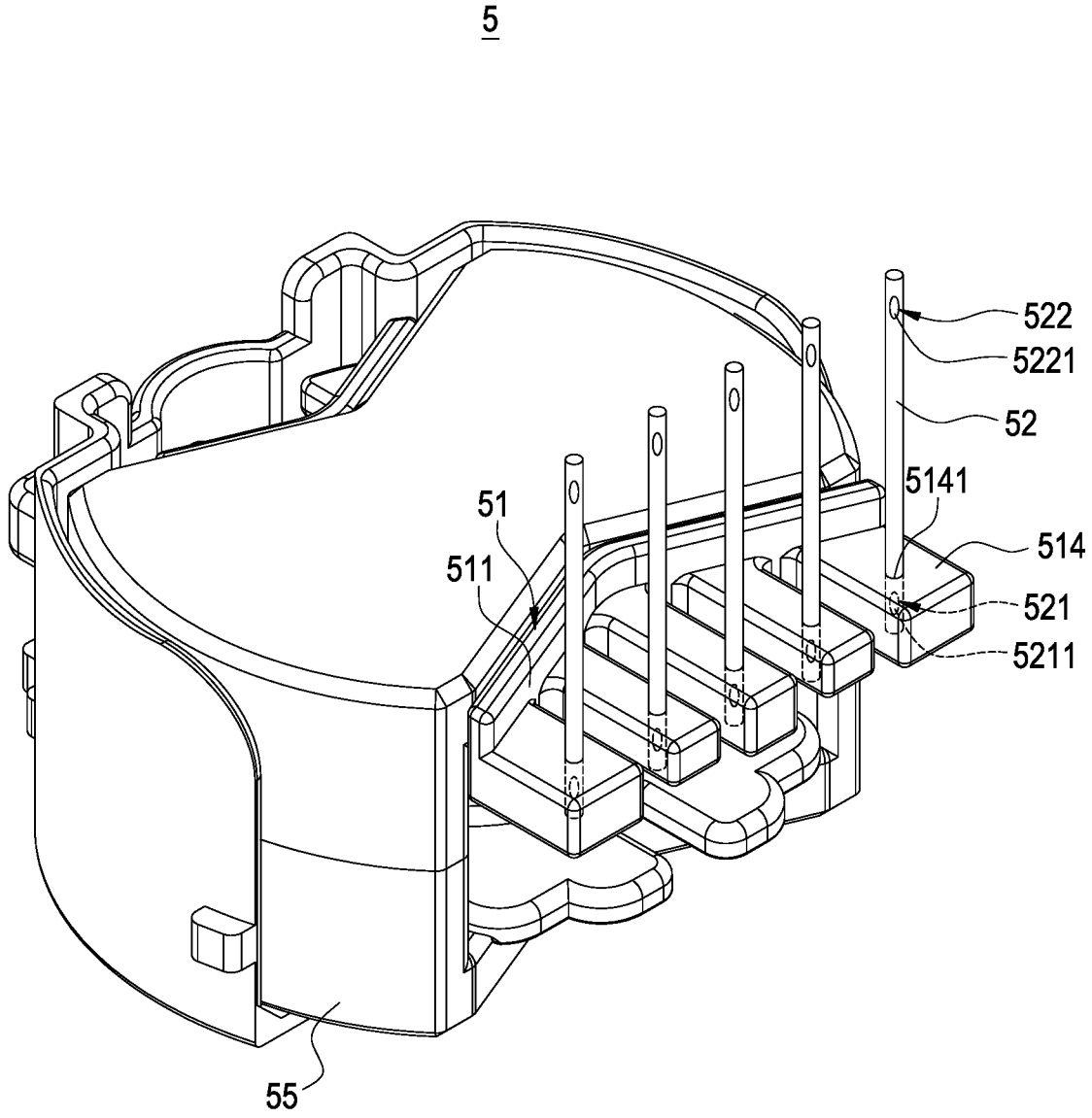
FIG. 9 is a schematic perspective view illustrating an alternative type of a transformer according to the first embodiment of the present invention.
Figure 10:
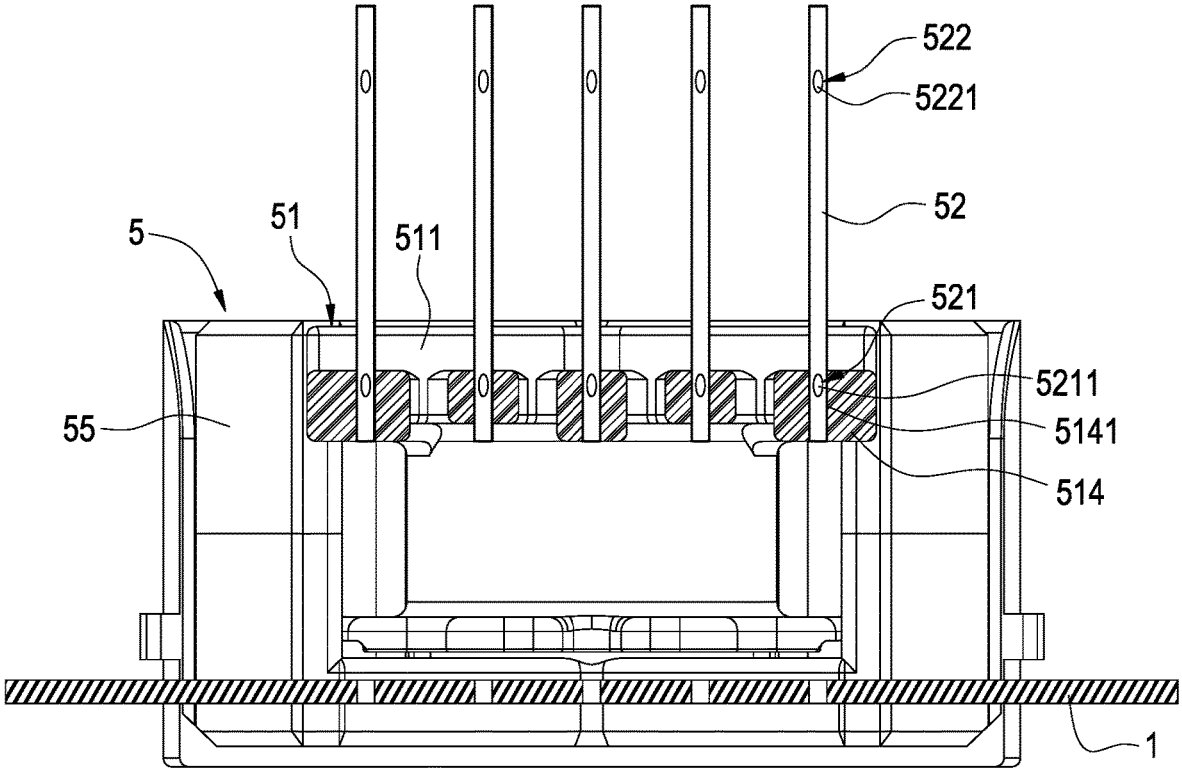
FIG. 10 is a schematic cross-sectional view illustrating the alternative type of the transformer disposed on a circuit board according to the first embodiment of the present invention.
Figure 11:
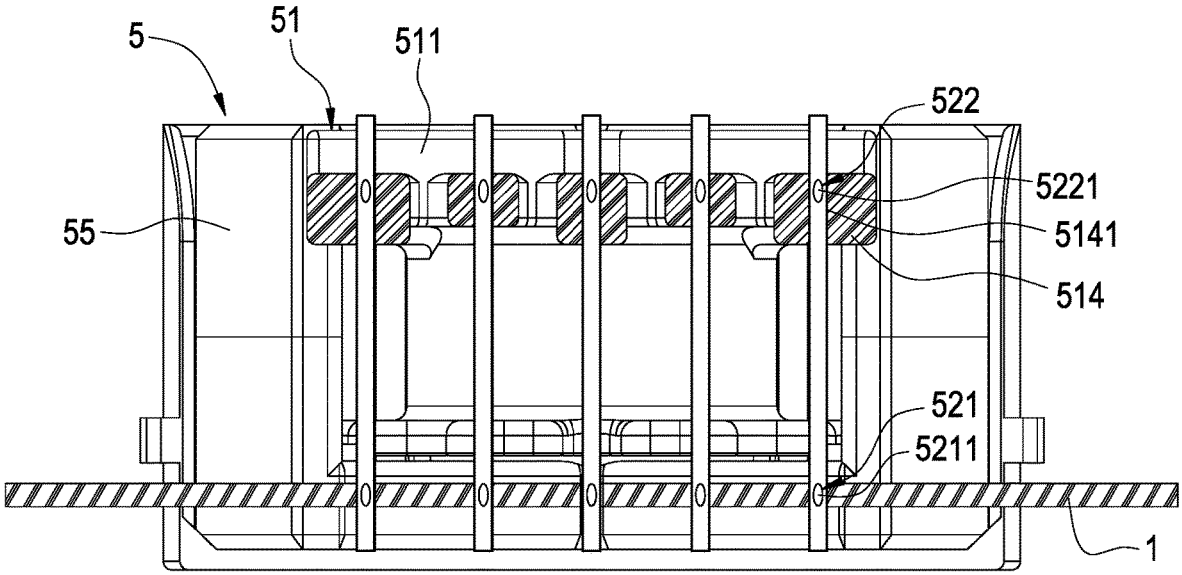
FIG. 11 is another schematic cross-sectional view illustrating the alternative type of the transformer disposed on the circuit board according to the first embodiment of the present invention.

Please refer to FIGS. 9 to 11, illustrating an alternative type of a transformer according to the present embodiment. This alternative-type transformer 5 is similar to the previous-type transformer 4 shown in FIGS. 1 to 8, of which the difference is that the transformer 5 shown in FIGS. 9 to 11 is a vertical type transformer and the transformer 4 shown in FIGS. 1 to 8 is a horizontal type transformer.

In detail, the transformer 5 is a vertical type transformer as shown in FIGS. 9 to 11. A protruding plate 514 extends from a side wall 511 of a bobbin 51 and includes a through hole 5141. A movable pin 52 includes a first latch portion 521 and a second latch portion 522. The movable pin 52 is inserted into the through hole 5141 until the first latch portion 521 is engaged and positioned in the through hole 5141. A second winding (not illustrated) is electrically connected to the movable pin 52. By a fixture (not illustrated), the movable pin 52 is then further moved downward through the through hole 5141 to cause deformation or damage of the first latch portion 521, and the movable pin 52 is thereby temporarily released until the second latch portion 522 is engaged and positioned in the through hole 5141. Hence, the transformer 5 carries out the same functions and effects as the transformer 4 shown in FIGS. 1 to 8. After the assembly of the transformer 5, the movable pin 52 is disposed on one side of an iron core set 55.

Similarly, in the present embodiment, the first latch portion 521 is a first pattern 5211 formed on the movable pin 52 by a texture process, and the second latch portion 522 is a second pattern 5221 formed on the movable pin 52 by the texture process; however, the present invention is not limited in this regard. In other varied embodiments, the first latch portion 521 and the second latch portion 522 can be formed on the movable pin 52 by, for example, adhesives or protruding dots.

According to the present embodiment, as shown in FIGS. 3, 4, 10 and 11, each movable pin 42, 52 is able to be selectively positioned at one of an upper position and a lower position. The movable pin 42, 52 is able to be positioned at the upper position (as shown in FIGS. 3 and 10) by tightly fitting the first pattern 4211, 5211 in the through hole 4141, 5141 for allowing the iron core set 45 to be assembled with the bobbin 41 (according to the horizontal-type transformer 4) or for allowing the first winding and the second winding to be wound onto the winding portion (according to the vertical-type transformer 5). The movable pin 42, 52 is able to be positioned at the lower position (as showing in FIGS. 4 and 11) by tightly fitting the second pattern 4221, 5221 in the through hole 4141, 5141 when the transformer 4, 5 is installed onto the circuit board 1.

Referring to FIGS. 12 to 17 and 24, a second embodiment of the present invention provides an adapter, a transformer, and an assembly method of the adapter. The adapter 10 includes a circuit board 1, a current processing module 2, a shielding plate 3, and a transformer 4. The transformer 4 includes a bobbin 41, one or more movable pin 42, an iron core set 45, one or more first windings 43, and one or more second windings 44.

Figure 13:
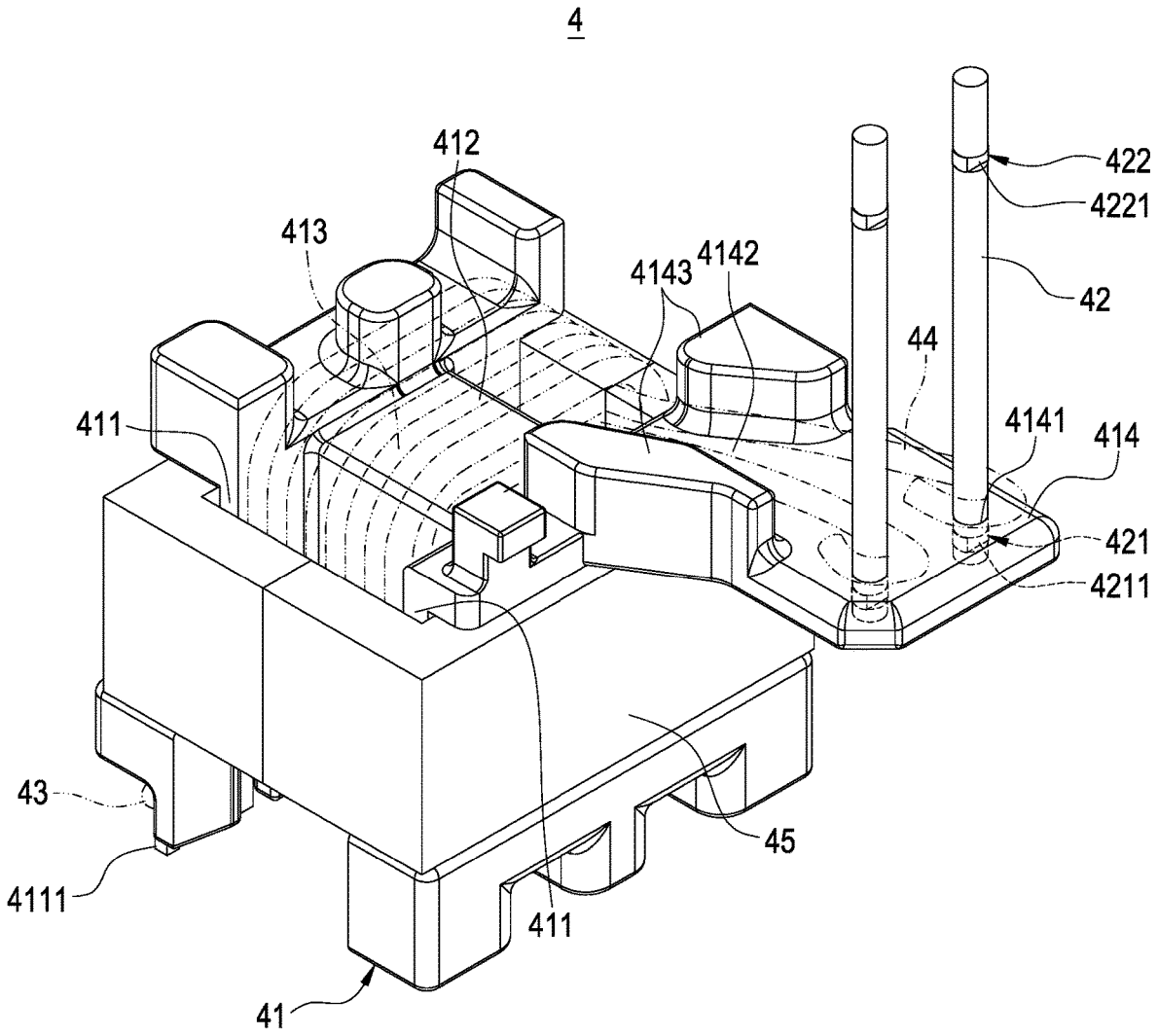
FIG. 13 is a schematic perspective view illustrating a transformer of the adapter according to the second embodiment of the present invention.
Figure 24:
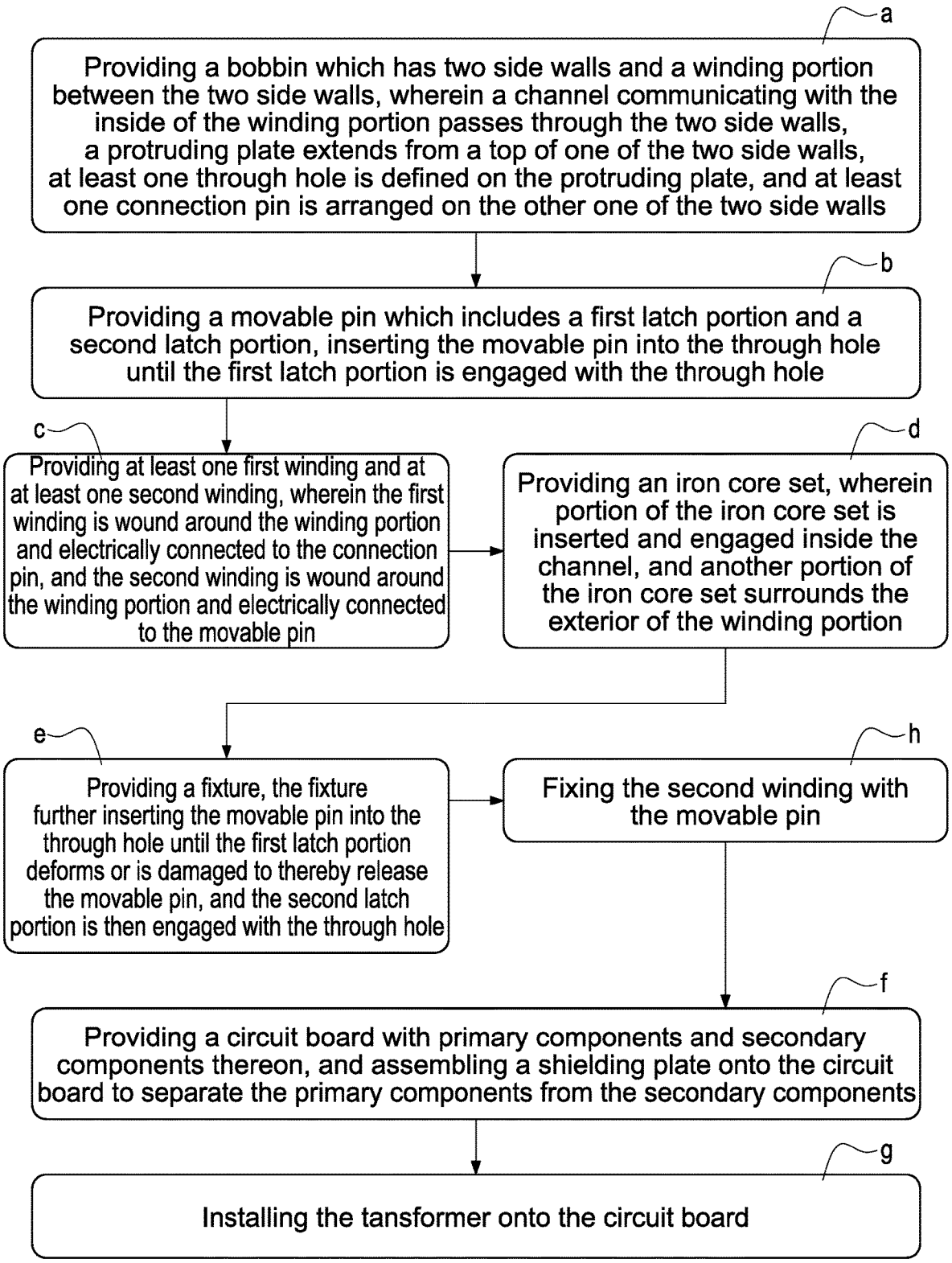
FIG. 24 is a diagram illustrating a process flow for an assembly method of an adapter according to the present invention.

Please refer to FIG. 24 showing a process flow for an assembly method of the adapter 10. First, in step a of FIG. 24, as shown in FIG. 13, a bobbin 41 is provided. The bobbin 41 includes two side walls 411, and a winding portion 412 arranged between the two side walls 411. A channel 413 communicating with an inside of the winding portion 412 passes through the two side walls 411, and a protruding plate 414 extending from a top of one of the two side walls 411. That is to say, the channel 413 is arranged below the protruding plate 414. One or more through holes 4141 are defined on the protruding plate 414, and one or more connection pins 4111 are arranged on the other one of the two side walls 411.

In step b of FIG. 24, as shown in FIG. 13, one or more movable pins 42 are provided. The movable pin 42 includes a first latch portion 421 and a second latch portion 422. The movable pin 42 is movably inserted into the through hole 4141, until the first latch portion 421 is tightly engaged and positioned in the through hole 4141 to set the movable pin 42 at an upper position.

In detail, in the present embodiment, the first latch portion 421 is a first pattern 4211 formed on the movable pin 42, and the second latch portion 422 is a second pattern 4221 formed on the movable pin 42. At least a part of the first pattern 4211 protrudes on a lateral surface of the movable pin 42, and at least a part of the second pattern 4221 protrudes on the lateral surface of the movable pin 42. Specifically, according to the present embodiment, the first pattern 4211 and the second pattern 4221 could be made by punching on parts of the lateral surface of the movable pin 42 to cause protruding deformation at other adjacent parts of the lateral surface of the movable pin 42. In general, a width (or a diameter) of the movable pin 42 is substantially the same as the diameter of the through hole 4141. However, the width of the movable pin 42 varies at the first latch portion 421 and the second latch portion 422, so that the width (or the diameter) of the first latch portion 421 and the width of the second latch portion 422 are different from the diameter of the through hole 4141. Accordingly, the movable pin 42 is movably assembled into the through hole 4141 of the protruding plate 414. As an example, in the present embodiment, the largest width of the first pattern 4211 is larger than the diameter of the through hole 4141, and the largest width of the second pattern 4221 is larger than the diameter of the through hole 4141; however, the present embodiment is not limited in this regard. In other varied embodiments, the first latch portion 421 and the second latch portion 422 can be formed on the movable pin 42 by adhesive or protruding dots. Namely, the movable pin 42 is movably disposed in the through hole 4141 and initially positioned at the upper position by tightly fitting the first latch portion 421 in the through hole 4141.

In step c of FIG. 24, as shown in FIG. 13, one or more first winding 43 and one or more second winding 44 are provided. The first winding 43 is wound around the winding portion 412 and is electrically connected to the connection pin 4111 by means of welding or adhesives, and the second winding 44 is wound around the winding portion 412 and is electrically connected to the movable pin 42.

In step d of FIG. 24, as shown in FIG. 13, the iron core set 45 is provided and is assembled with the bobbin 41. A portion of the iron core set 45 is inserted and engaged inside the channel 413, and another portion of the iron core set 45 surrounds the exterior of the winding portion 412.

Figure 16:
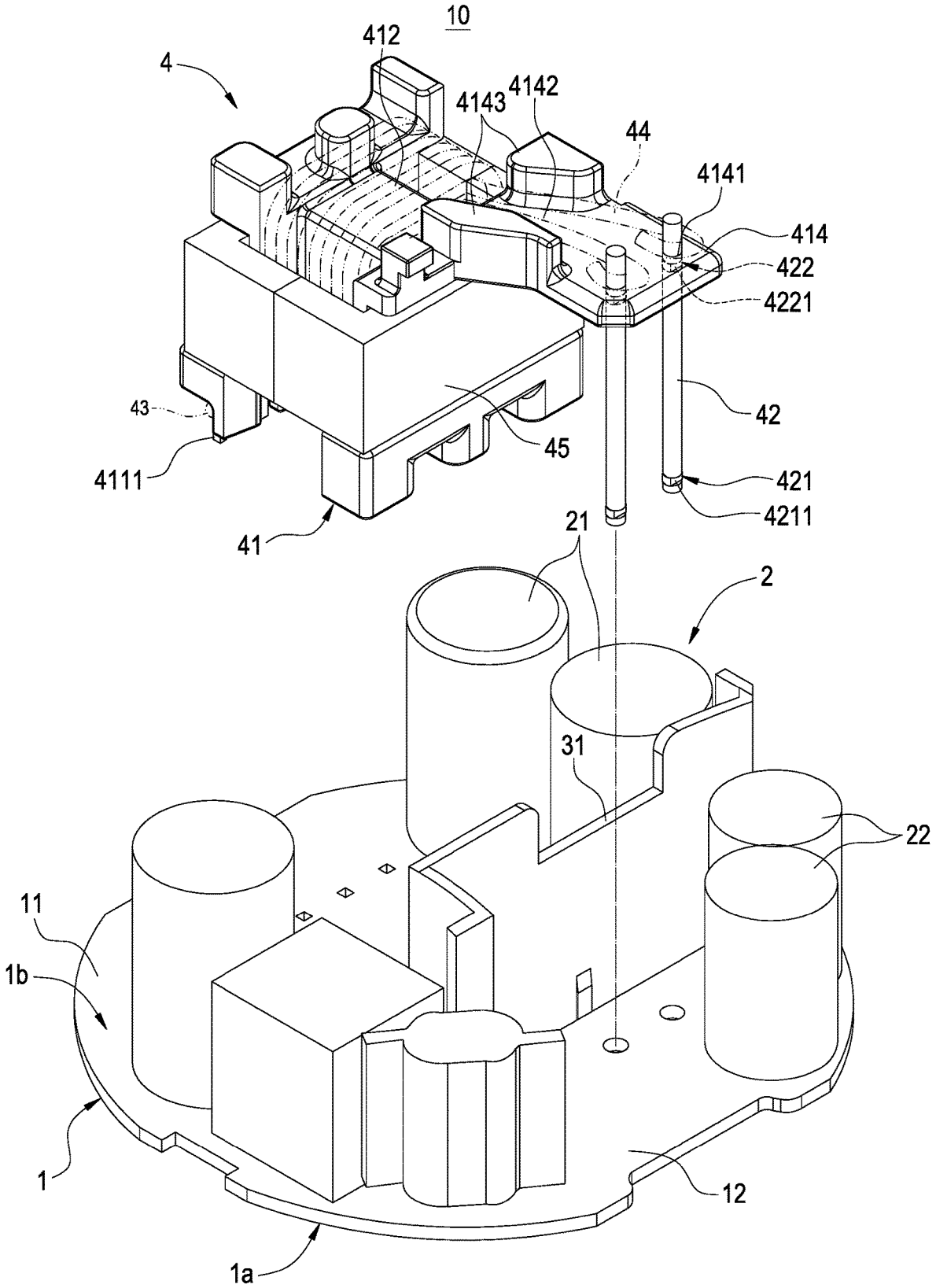

In step e of FIG. 24, as shown in FIGS. 13 and 16, a fixture (not illustrated) is provided. The fixture further drives down the movable pin 42 and forces it continually moving through the through hole 4141 until the first latch portion 421 deforms or is damaged. At the moment, the first latch portion 421 is no longer engaged with the protruding plate 414 and thereby the movable pin 42 is released temporarily. Finally, the second latch portion 422 is then engaged with the through hole 4141 to position the movable pin 42 at a lower position.

Furthermore, as shown in FIGS. 13 and 16, a wiring groove 4142 is disposed on a top of the protruding plate 414 and arranged in a direction from the winding portion 412 toward the through hole 4141. Two guiding blocks 4143 extend from the top of the protruding plate 414, and the wiring groove 4142 is formed between the two guiding blocks 4143. The wiring groove 4142 is used to receive the second winding 44, so that the second winding 44 is confined between the two guiding blocks 4143.

In step h of FIG. 24, as shown in FIG. 16, right after step e, the second winding 44 is fixed with the movable pin 42 by means of welding or adhesives. Namely, before step h is implemented after step e, the second winding 44 is only temporarily and detachably connected to the movable pin 42 during step d and step e. In other embodiments, step h can also be implemented right after step c or step d (which is similar to the first embodiment).

In step f of FIG. 24, as shown in FIGS. 14 to 17, the circuit board 1 is provided. The circuit board 1 is divided into a primary area 11 and a secondary area 12. The current processing module 2 includes a plurality of primary components 21 and a plurality of secondary components 22. The primary components 21 are installed in the primary area 11 and are electrically connected to the circuit board 1. The secondary components 22 are installed in the secondary area 12 and are electrically connected to the circuit board 1.

Furthermore, since the present adapter 10 is downsized due to the miniaturization trend of electronic product, the primary components 21 are close to the secondary components 22. Therefore, the shielding plate 3 is arranged on the circuit board 1 and between the primary area 11 and the secondary area 12. That is, the shielding plate 3 is arranged between the primary components 21 and the secondary components 22, and the shielding plate 3 separates the primary components 21 from the secondary components 22 to maintain a sufficient creepage distance and prevent the primary components 21 and the secondary components 22 from affecting each other during the operations of the adapter 10. The shielding plate 3 is made of plastic or other suitably insulating materials, and includes a recess 31 indented from a top of the shielding plate 3.

Figure 14:
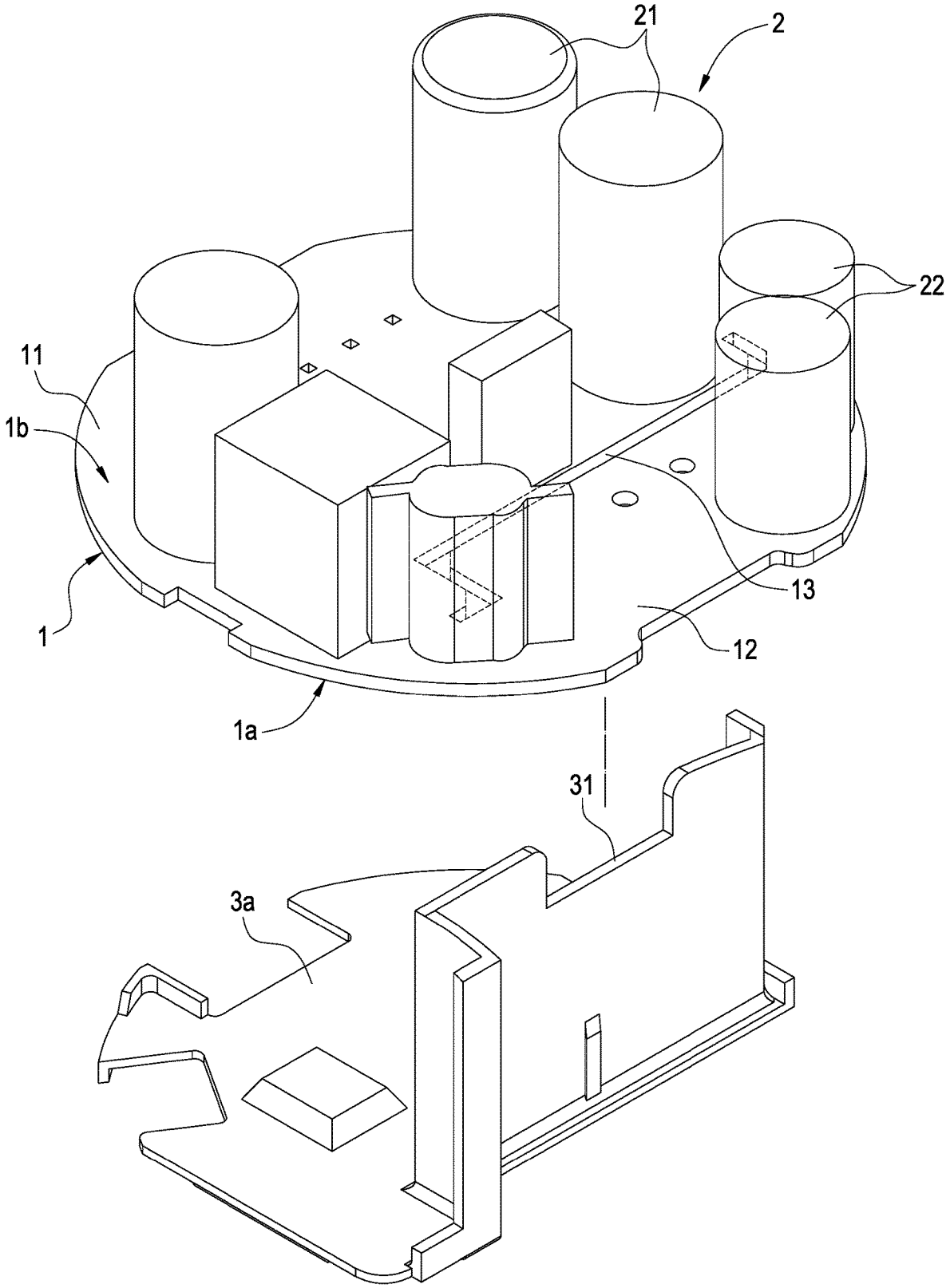
FIGS. 14 to 17 are schematic partial exploded views illustrating assembling of the adapter according to the second embodiment of the present invention.

Specifically, according to FIG. 14, an assembling slot 13 corresponding to the shielding plate 3 could be defined on the circuit board 1 between the primary area 11 and the secondary area 12. A base 3*a* is extended from a bottom of the shielding plate 3 along a lateral direction of the shielding plate 3. The shielding plate 3 is inserted through the assembling slot 13 from a bottom surface 1*a* of the circuit board 1, so that the shielding plate 3 is upright arranged on a top surface 1*b* of the circuit board 1 and between the primary area 11 and the secondary area 12. Therefore, the primary components 21 and the primary components 22 are separated from each other by the shielding plate 3. Furthermore, the bottom surface 1*a* of the circuit board 1 is partially covered by the base 3*a* for further insulation of the circuit board 1 and further fixing of the shielding plate 3.

Figure 15:
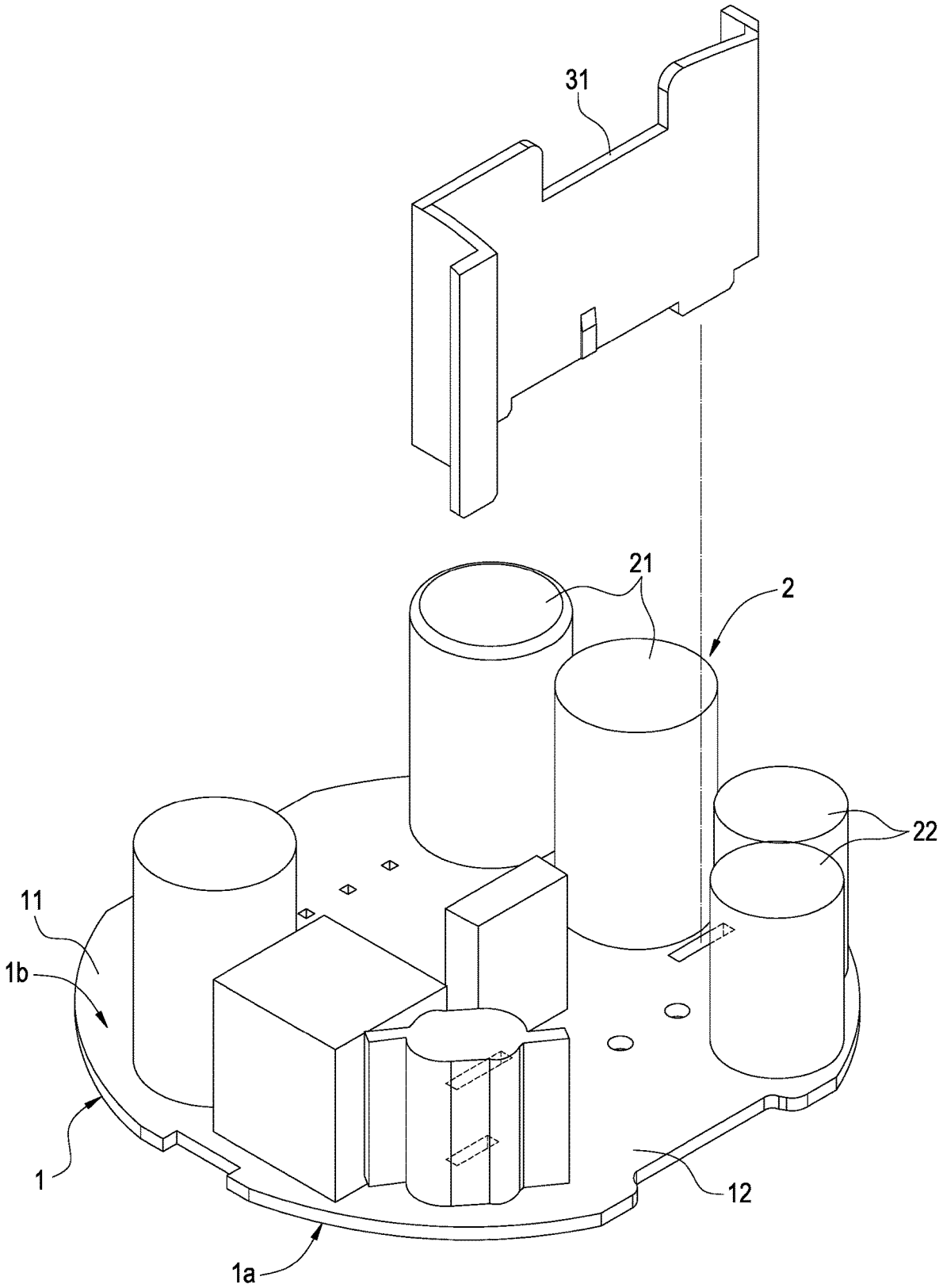

Alternatively, according to FIG. 15, the shielding plate 3 could be directly assembled onto the top surface 1*b* of the circuit board 1 and be fixed with the circuit board 1 by embedding, latching, or adhesives.

Figure 12:
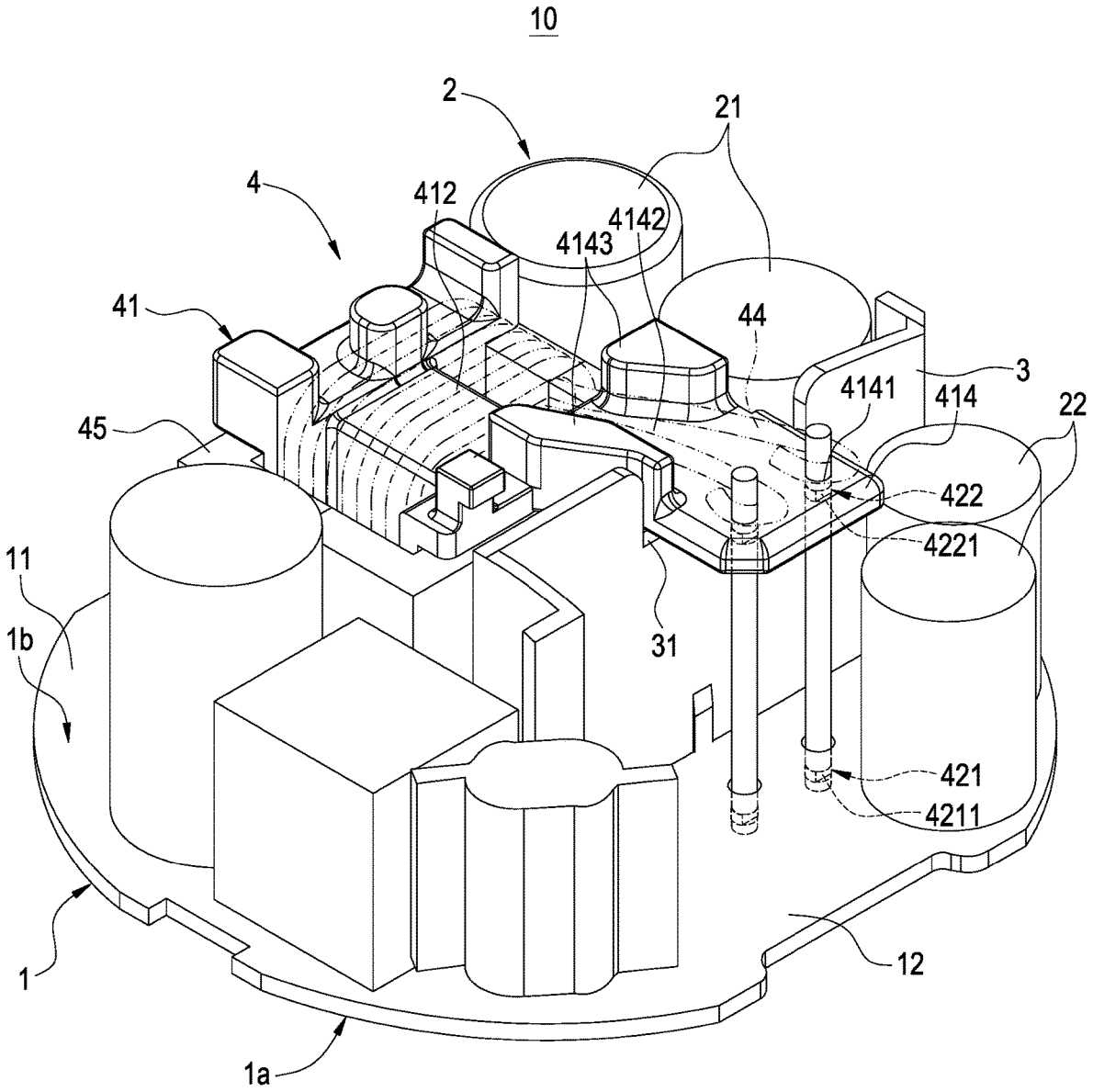
FIG. 12 is a schematic perspective view illustrating an adapter according to a second embodiment of the present invention.
Figure 17:
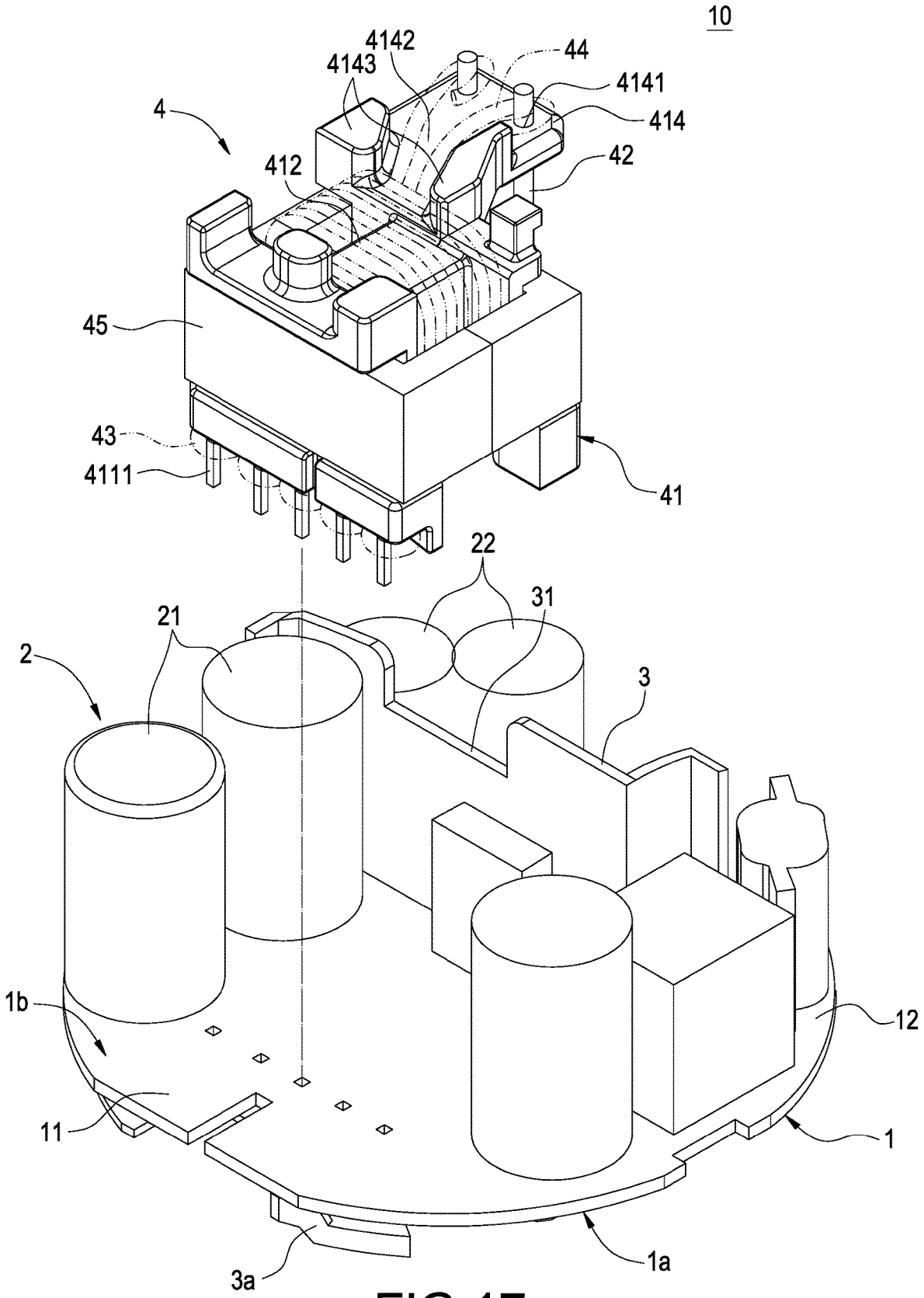

In step g of FIG. 24, as shown in FIGS. 16, 17 and 12, the transformer 4 is installed onto the circuit board 1, so that most part of the bobbin 41 is disposed on one side of the shielding plate 3 (on the primary area 11), and the protruding plate 414 is engaged with the recess 31 to make the protruding plate 414 extending across the shielding plate 3 and reaching over the secondary area 12.

Meanwhile, the connection pin 4111 is inserted and electrically connected to the primary area 11, and the primary components 21 are electrically connected to the first winding 43 through the circuit board 1 and the connection pin 4111, so that the primary components 21 can process an input current from supply mains, and then can deliver a processed current to the first winding 43. The movable pin 42 is inserted through the through hole 4141 and electrically connected to the secondary area 12, and the secondary components 22 are electrically connected to the second winding 44 through the circuit board 1 and the movable pin 42, so that the secondary components 22 can perform a subsequent process on a current outputted from the second winding 44.

In the present embodiment, the first winding 43 and the connection pin 4111 are electrically connected to the primary components 21, so the first winding 43 is a primary winding, and the connection pin 4111 is a primary pin. The second winding 44 and the movable pin 42 are electrically connected to the secondary components 22, so the second winding 44 is a secondary winding, and the movable pin 42 is a secondary pin. However, the present invention is not limited to the embodiment disclosed. Configurations may be modified according to requirement. In other varied embodiments, the first winding 43 can be a secondary winding, and the connection pin 4111 can be a secondary pin; the second winding 44 can be a primary winding, and the movable pin 42 can be a primary pin.

Furthermore, as shown in FIGS. 12 and 16, since the second latch portion 422 is disposed above the first latch portion 421 and the movable pin 42 is disposed on one side of the iron core set 45 when the second latch portion 422 is engaged and positioned in the through hole 4141, the first latch portion 421 is arranged away from the protruding plate 414. In other words, the first latch portion 421 is arranged close to the circuit board 1.

In conventional techniques, a second winding is directly welded to a circuit board by manual manner. By contrast, the adapter 10 and the transformer 4 can be assembled in an automated process using robot arms to complete the following procedures. The movable pin 42 is inserted into the through hole 4141 and initially positioned at the upper position by tightly fitting the first latch portion 421 in the through hole 4141. The iron core set 45 is assembled to the bobbin 41. Due to the fixture, the first latch portion 421 is deformed or damaged to temporarily release the movable pin 42, and the movable pin 42 is then moved to the lower position and positioned by tightly fitting the second latch portion 422 in the through hole 4141. Then, the second winding 44 is electrically connected to the movable pin 42 and fixed with it by means of welding or adhesives. The transformer 4 is installed on the circuit board 1, and the bobbin 41 is mainly disposed on the primary area 11. The protruding plate 414 extends across the shielding plate 3 to reach over the secondary area 12, and the movable pin 42 is meanwhile inserted into the secondary area 12 of the circuit board 1. Thus, by the automated process, the labor costs of the adapter 10 are reduced, and the assembly efficiency of the adapter 10 is enhanced, together with the improved production yields.

Furthermore, as shown in FIGS. 12 and 13, after the assembly of the transformer 4, the movable pin 42 is disposed on one side of the iron core set 45. If the movable pin 42 is fixed and immobile on one side of the iron core set 45 (i.e., at the lower position) in the very beginning of the assembly of the transformer 4, it is not possible to install the iron core set 45 during assembling (because the unsettled iron core set 45 would be blocked by the movable pin 42 at the lower position). Therefore, the movable pin 42 is designed to be movable and is positioned by means of the first latch portion 421 and the second latch portion 422 in sequence, so that the iron core set 45 can be installed without obstacles (according to the case of horizontal type transformers, as described in this embodiment). Additionally, in another embodiment of a vertical type transformer (see FIG. 18), if a movable pin is fixed and immobile on one side of an iron core set in the very beginning of the assembly of the transformer, it is not possible to wind a first winding and a second winding during assembling (because the unsettled windings would be blocked by the movable pin at a lower position). Therefore, the movable pin is designed to be movable and is positioned by similar means of a first latch portion and a second latch portion in sequence, so that the first winding and the second winding can be wound without obstacles.

Moreover, as shown in FIGS. 12 and 17, due to the miniaturization trend of electronic product, the adapter 10 is downsized, and as a result, the primary pin would become much more close to the secondary pin, which fails to provide a minimum insulation distance (e.g., creepage distance) to meet the safety regulations. Therefore, in order to provide an sufficient insulation distance as required by the safety regulations for the downsized adapter 10, the protruding plate 414 is arranged to increase an additional distance between the connection pin 4111 and the movable pin 42 of the transformer 4 (in which one of them is the primary pin and the other one is the secondary pin).

Moreover, in the above-mentioned embodiment, the movable pin 42 is disposed on only one side of the transformer 4 (e.g., the secondary side of the transformer 4). It should be noted that, in other varied embodiments, one movable pin 42 can be disposed on one side (e.g., a secondary side of a transformer) and another movable pin 42 can be disposed on the other side (e.g., a primary side of the transformer). Therefore, this modification is still within the protection scope of the present invention. In detail, as shown in FIGS. 12, 13, 16 and 17, in the present embodiment, although the connection pin 4111 is a fixed pin, the present invention is not limited to this particular form. That is, the connection pin 4111 can also be a movable-type pin in the embodiment shown in FIG. 21. If there are two protruding plates extending from two side walls of a bobbin, respectively, a connection pin can also be a movable-type pin (similar to the structure of the movable pin 42), which is also inserted into a through hole defined on one of the two protruding plates.

Figure 18:
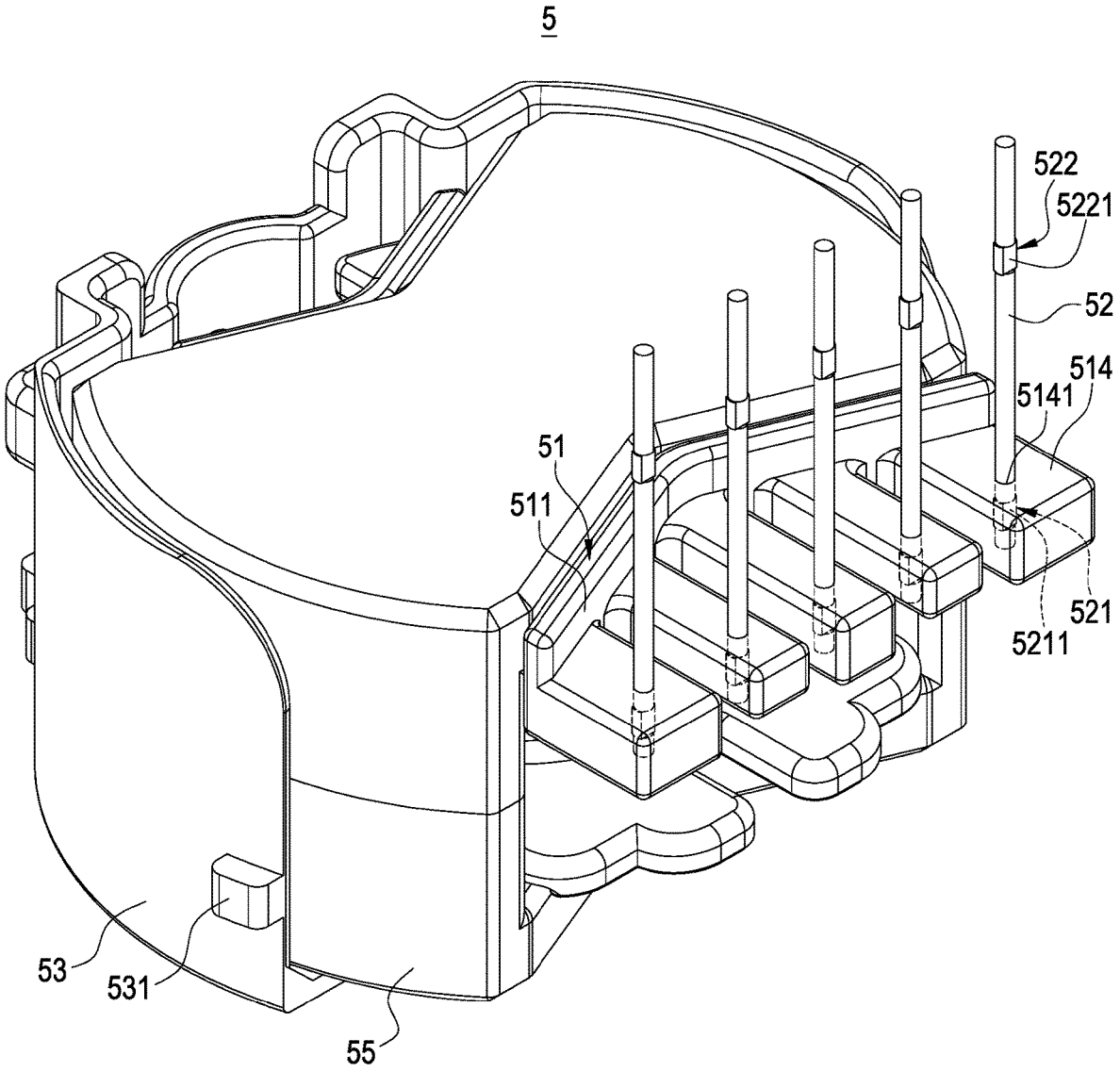
FIGS. 18 to 20 are schematic views illustrating assembling of an alternative type of a transformer according to the second embodiment of the present invention.
Figure 19:
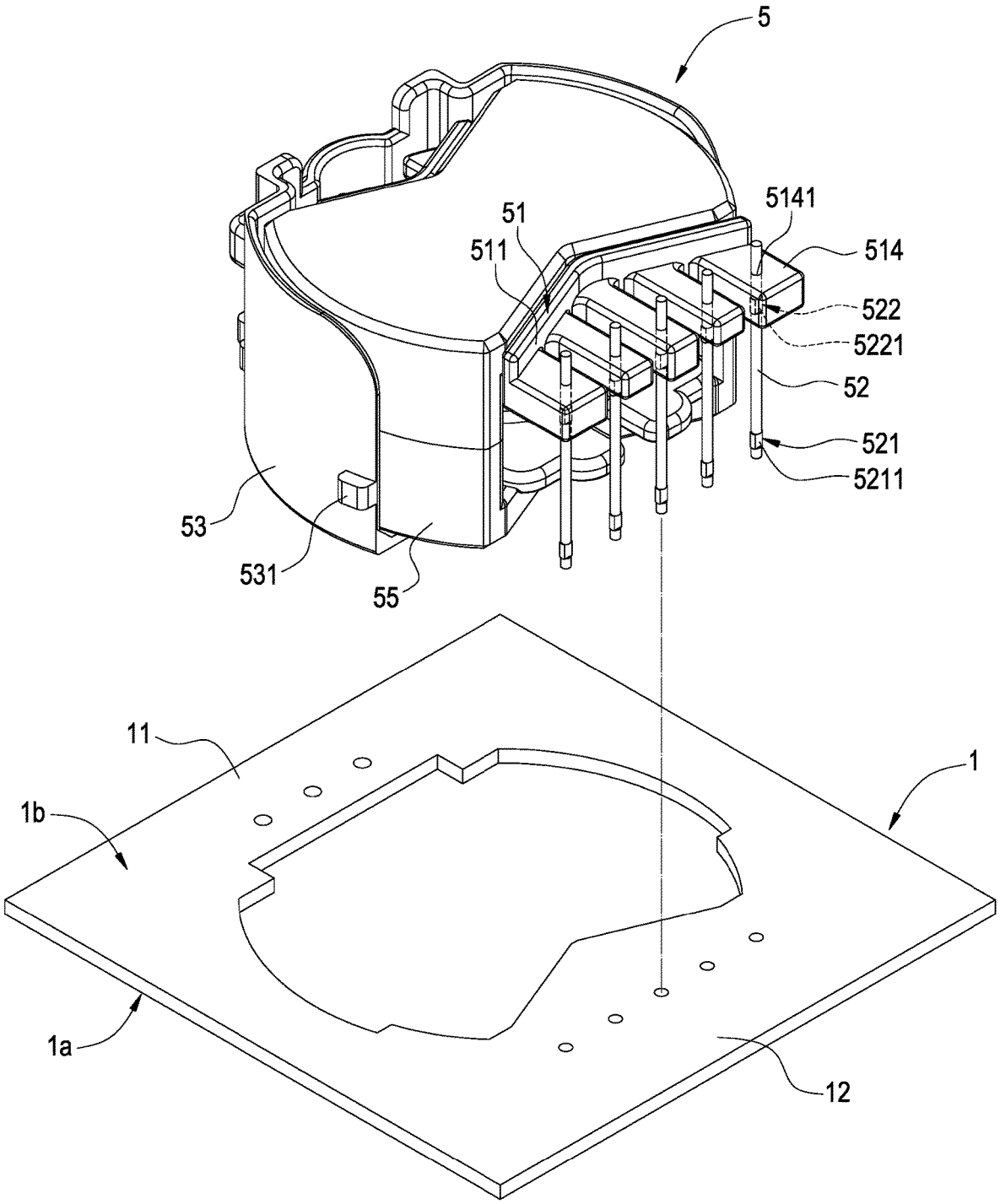
Figure 20:
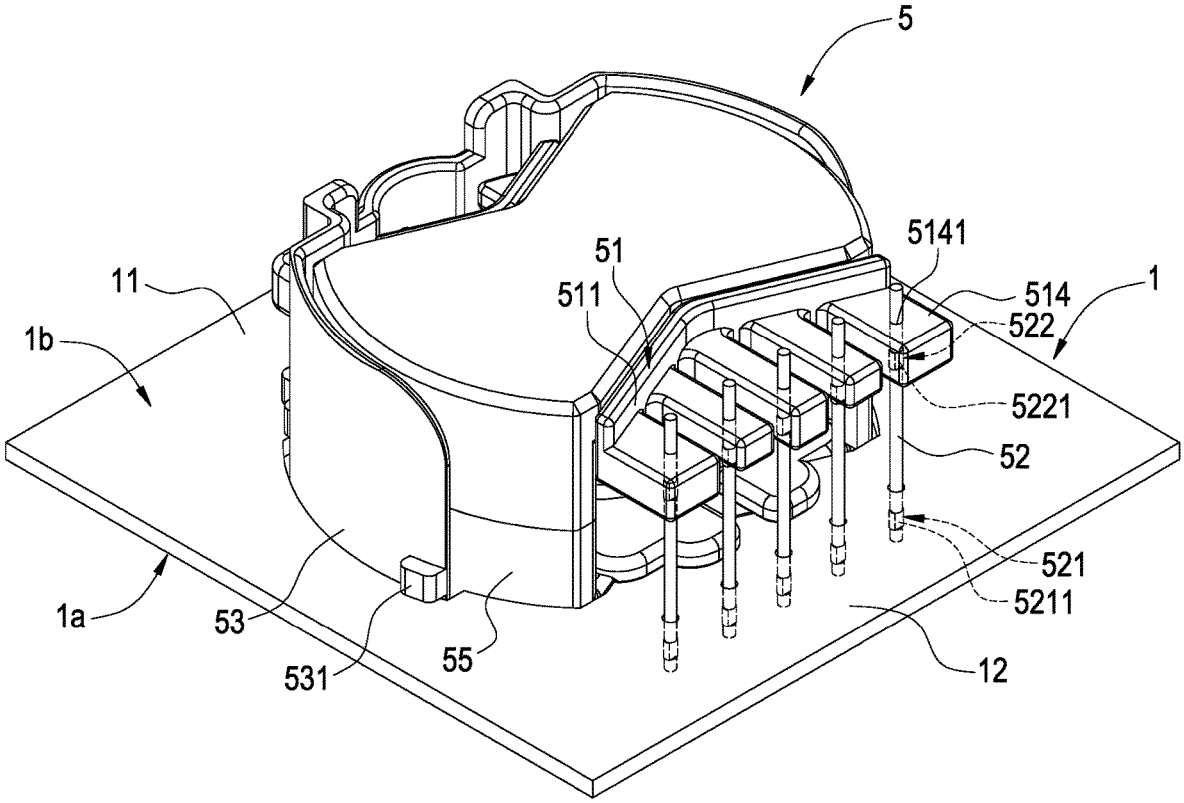
Figure 21:
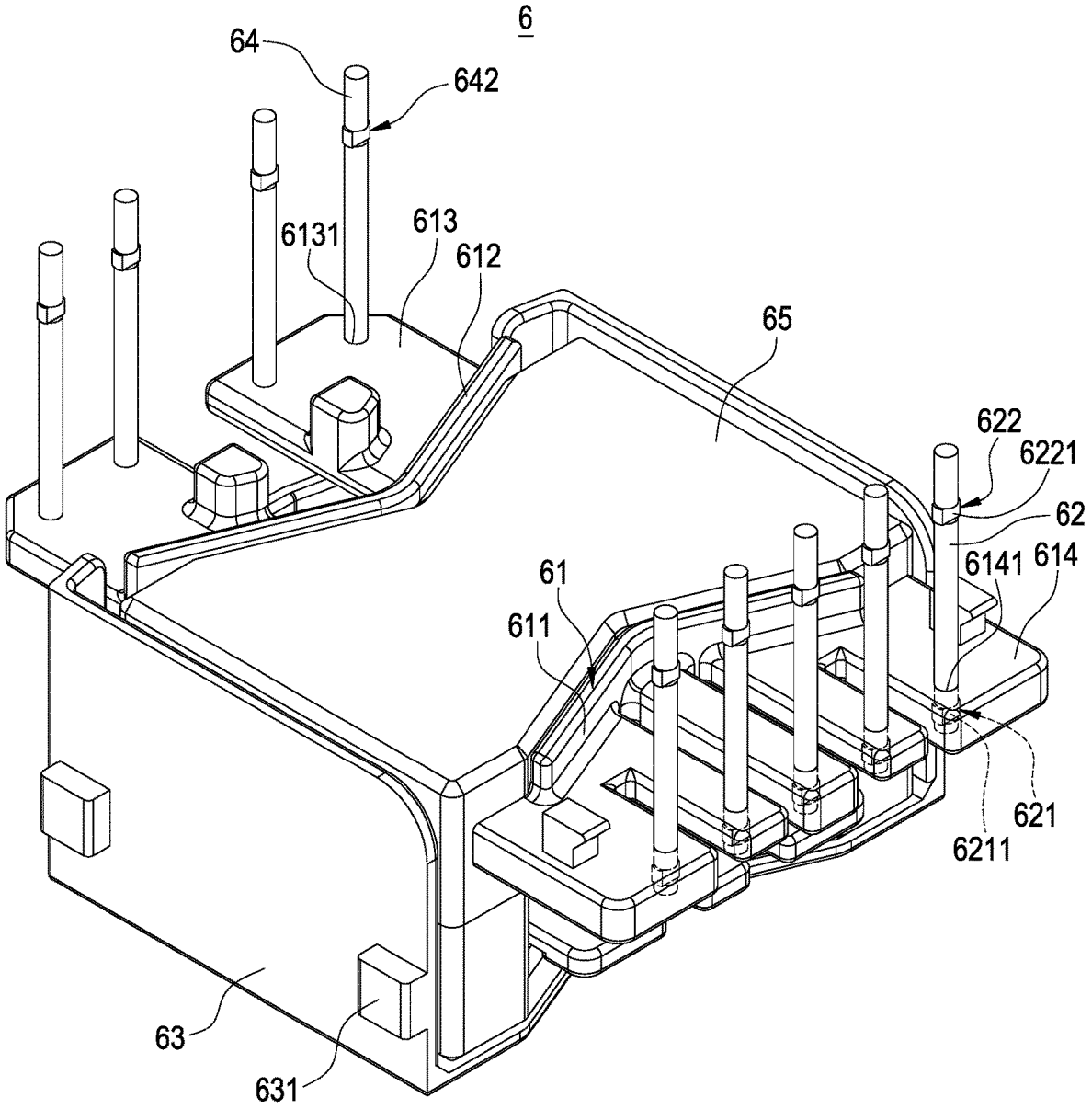
FIGS. 21 to 23 are schematic views illustrating assembling of a further alternative type of a transformer according to the second embodiment of the present invention.
Figure 22:
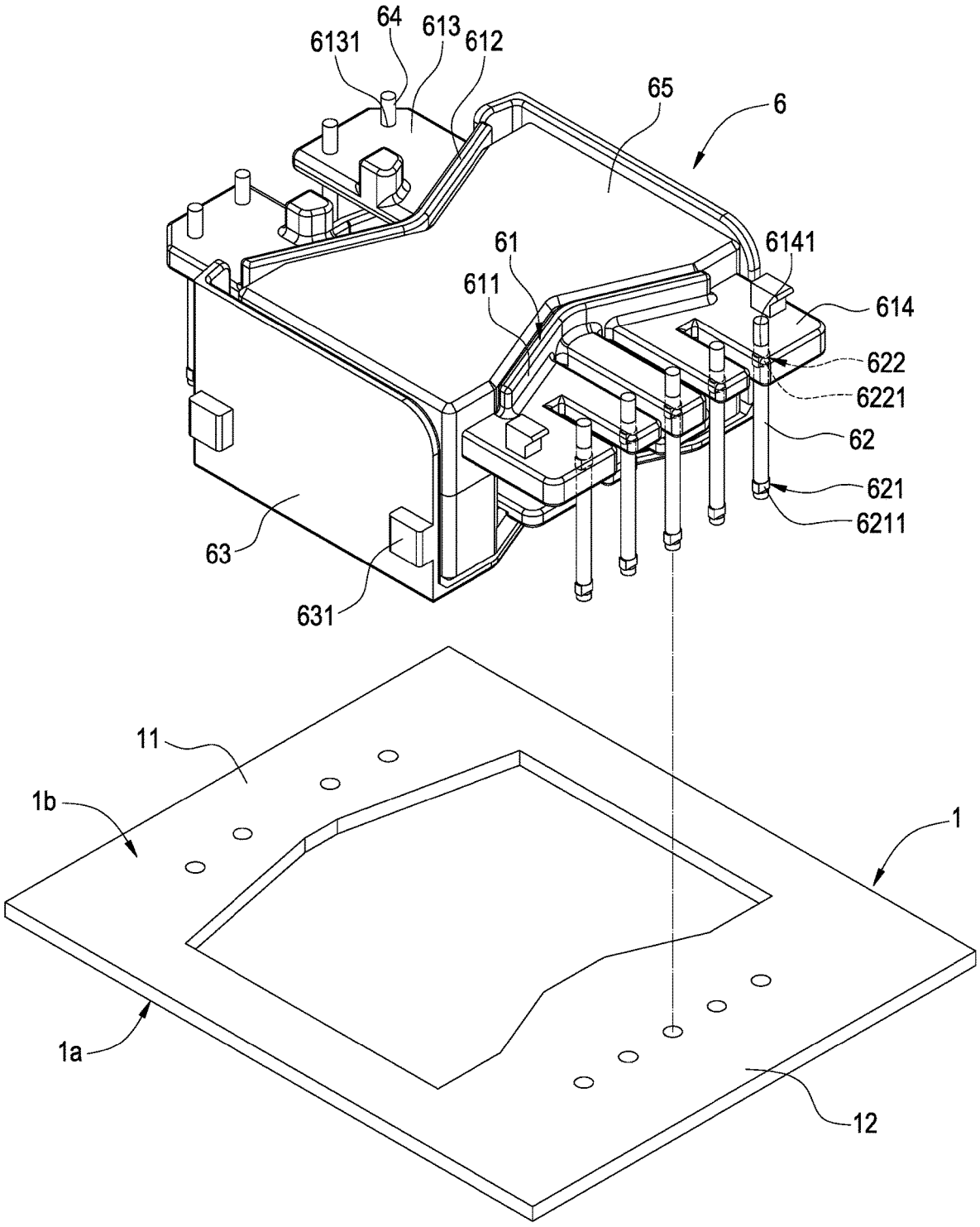
Figure 23:
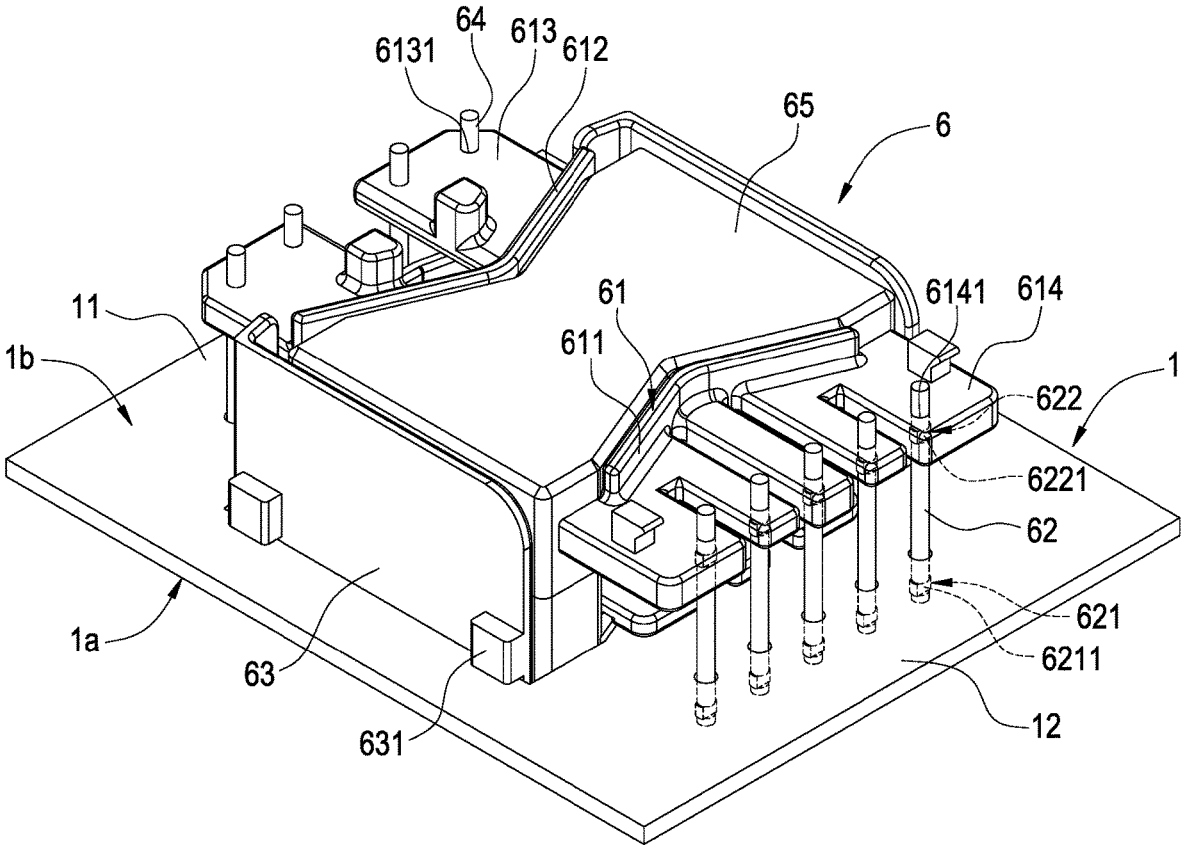

Please refer to FIGS. 18 to 20, illustrating an alternative type of a transformer according to the second embodiment, and refer to FIGS. 21 to 23, illustrating a further alternative type of a transformer according to the second embodiment. The alternative-type transformer 5 is similar to the previous-type transformer 4 shown in FIGS. 12, 13, 16 and 17, of which the difference is that the transformer 5 shown in FIGS. 18 to 20 is a vertical type transformer and the transformer 4 shown in FIGS. 12, 13, 16 and 17 is a horizontal type transformer. On the other hand, the transformer 6 shown in FIGS. 21 to 23 is another vertical type transformer.

In detail, the transformer 5 shown in FIGS. 18 to 20 is a vertical type transformer. A protruding plate 514 extends from a side wall 511 of a bobbin 51 and includes a through hole 5141. A movable pin 52 includes a first latch portion 521 and a second latch portion 522. The movable pin 52 is inserted into the through hole 5141 until the first latch portion 521 is engaged and positioned in the through hole 5141. A second winding (not illustrated) is electrically connected to the movable pin 52. By a fixture (not illustrated), the movable pin 52 is then further moved downward through the through hole 5141 to cause deformation or damage of the first latch portion 521, and the movable pin 52 is thereby temporarily released until the second latch portion 522 is engaged and positioned in the through hole 5141. Hence, the transformer 5 carries out the same functions and the effects as the transformer 4 shown in FIGS. 12, 13, 16 and 17. After the assembly of the transformer 5, the movable pin 52 is disposed on one side of an iron core set 55.

The vertical-type transformer 5 shown in FIGS. 18 to 20 is similar to the previously mentioned vertical-type transformer 5 of the first embodiment as shown in FIGS. 9 to 11, but their first latch portions 521 and their second latch portions 522 are different from each other. In the second embodiment, the first latch portion 521 is also a first pattern 5211 formed on the movable pin 52, and the second latch portion 522 is also a second pattern 5221 formed on the movable pin 52. However, in the present embodiment, the first pattern 5211 and the second pattern 5221 are made by punching on parts of a lateral surface of the movable pin 52 to cause protruding deformation at other adjacent parts of the lateral surface of the movable pin 52.

According to the transformer 5 shown in FIGS. 18 to 20, at least a part of the iron core set 55 is wrapped by an insulation cover 53, and the insulation cover 53 can also be used for at least partially separating a primary area 11 from a secondary area 12 on a circuit board 1, as shown in FIGS. 19 and 20. A stopping block 531 is protrusively disposed on an external lateral surface of the insulation cover 53 for positioning the transformer 5 at a specific depth when the transformed 5 is embedded into a hollowed aperture of the circuit board 1, as shown in FIG. 20.

On the other hand, also in detail, the transformer 6 shown in FIGS. 21 to 23 is another vertical type transformer. A protruding plate 614 extends from a side wall 611 of a bobbin 61 and includes a through hole 6141. A movable pin 62 includes a first latch portion 621 and a second latch portion 622. The movable pin 62 is inserted into the through hole 6141 until the first latch portion 621 is engaged and positioned in the through hole 6141. A second winding (not illustrated) is electrically connected to the movable pin 62. By a fixture (not illustrated), the movable pin 62 is then further moved downward through the through hole 6141 to cause deformation or damage of the first latch portion 621, and the movable pin 62 is thereby temporarily released until the second latch portion 622 is engaged and positioned in the through hole 6141. Hence, the transformer 6 carries out the same functions and the effects as the transformer 5 shown in FIGS. 18 to 20. After the assembly of the transformer 6, the movable pin 62 is disposed on one side of an iron core set 65.

The vertical-type transformer 6 shown in FIGS. 21 to 23 is similar to the above-mentioned vertical-type transformer 5 shown in FIGS. 18 to 20, in which the difference is that the transformer 6 further includes another protruding plate 613 extending from another side wall 612 of the bobbin 61, another through hole 6131 defined on the protruding plate 613, and another movable pin 64 movably disposed in the through hole 6131. The movable pin 64 also includes a third latch portion (not illustrated) and a fourth latch portion 642, wherein the third latch portion and the fourth latch portion 642 are similar to the first latch portion 621 and the second latch portion 622, respectively. The first latch portion 621 is a first pattern 6211 formed on the movable pin 62, and the second latch portion 622 is a second pattern 6221 formed on the movable pin 62. In the present embodiment, the first pattern 6211 and the second pattern 6221 are made by punching on parts of a lateral surface of the movable pin 62 to cause protruding deformation at other adjacent parts of the lateral surface of the movable pin 62.

According to the transformer 6 shown in FIGS. 21 to 23, at least a part of the iron core set 65 is wrapped by an insulation cover 63, and the insulation cover 63 can also be used for at least partially separating a primary area 11 from a secondary area 12 on a circuit board 1, as shown in FIGS. 22 and 23. A stopping block 631 is protrusively disposed on an external lateral surface of the insulation cover 63 for positioning the transformer 6 at a specific depth when the transformed 6 is embedded into a hollowed aperture of the circuit board 1, as shown in FIG. 23.

According to the present embodiment, as shown in FIGS. 13, 16, 18, 19, 21 and 22, each movable pin 42, 52, 62, 64 is able to be selectively positioned at one of an upper position and a lower position, the movable pin 42, 52, 62, 64 is able to be positioned at the upper position (as shown in FIGS. 13, 18 and 21) by tightly fitting the first pattern 4211, 5211, 6211 in the through hole 4141, 5141, 6141 for allowing the iron core set 45 to be assembled with the bobbin 41 (according to the horizontal-type transformer 4) or for allowing the first winding and the second winding to be wound onto the winding portion (according to the vertical-type transformers 5, 6). The movable pin 42, 52, 62, 64 is able to be positioned at the lower position (as shown in FIGS. 16, 19 and 22) by tightly fitting the second pattern 4221, 5221, 6221 in the through hole 4141, 5141, 6141 when the transformer 4, 5, 6 is installed onto the circuit board 1.

In summary, the adapter, the transformer, and the assembly methods of the adapter and the transformer of the present invention can achieve anticipated objectives and solve the conventional defects. The present invention also has industrial applicability, novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. An adapter, comprising:

a circuit board;

a current processing module including a plurality of primary components and a plurality of secondary components installed and electrically connected to the circuit board;

a shielding plate disposed between the primary components and the secondary components; and a transformer installed on the circuit board, the transformer comprising:

a bobbin disposed on one side of the shielding plate, the bobbin including two side walls and a winding portion arranged between the two side walls, a protruding plate extending from one of the side walls and being disposed across the shielding plate, at least one through hole being defined on the protruding plate, a connection pin being arranged on the other side wall, the connection pin being inserted into the circuit board;

an iron core set assembled with the bobbin;

at least one movable pin including a first latch portion and a second latch portion, the movable pin being movably disposed in the through hole, the second latch portion is disposed above the first latch portion, the movable pin is disposed on one side of the iron core set, the first latch portion is a first pattern formed on the movable pin, and the second latch portion is a second pattern formed on the movable pin, the largest width of the first pattern is larger than a diameter of the through hole, and the largest width of the second pattern is larger than the diameter of the through hole;

at least one first winding wound around the winding portion and electrically connected to the connection pin; and at least one second winding wound around the winding portion and electrically connected to the movable pin, wherein the movable pin is selectively positioned at one of an upper position and a lower position, the movable pin is positioned at the upper position by tightly fitting the first pattern in the through hole for allowing the iron core set to be assembled with the bobbin or for allowing the first winding and the second winding to be wound onto the winding portion, and the movable pin is positioned at the lower position by tightly fitting the second pattern in the through hole when the transformer is installed onto the circuit board.

2. The adapter according to claim 1, wherein a channel communicating with an inside of the winding portion passes through the two side walls, the channel is arranged below the protruding plate, a portion of the iron core set is inserted and engaged inside the channel, and another portion of the iron core set surrounds the exterior of the winding portion.

3. The adapter according to claim 1, wherein the circuit board is divided into a primary area and a secondary area, the shielding plate is disposed on the circuit board and is disposed between the primary area and the secondary area, the primary components and the connection pin are installed and electrically connected to the primary area, and the secondary components and the movable pin are installed and electrically connected to the secondary area.

4. The adapter according to claim 1, wherein the shielding plate includes a recess indented from a top of the shielding plate, and the protruding plate is engaged with the recess.

5. The adapter according to claim 1, wherein a wiring groove is disposed on a top of the protruding plate and arranged in a direction from the winding portion toward the through hole, two guiding blocks extend from the top of the protruding plate, and the wiring groove is formed between the two guiding blocks.

6. The adapter according to claim 1, wherein an assembling slot corresponding to the shielding plate is defined on the circuit board, the shielding plate is inserted through the assembling slot from a bottom surface of the circuit board.

7. The adapter according to claim 6, wherein a base is extended from a bottom of the shielding plate along a lateral direction of the shielding plate, and the bottom surface of the circuit board is at least partially covered by the base.

8. The adapter according to claim 1, wherein the first pattern and the second pattern are respectively made by punching on parts of a lateral surface of the movable pin to cause protruding deformation at other adjacent parts of the lateral surface of the movable pin.

9. The adapter according to claim 1, wherein the first pattern and the second pattern are respective rough surfaces made by texture process.

10. A transformer, suitable for an adapter, the transformer comprising:

a bobbin including two side walls and a winding portion arranged between the two side walls, a protruding plate extending from one of the side walls, at least one through hole being defined on the protruding plate, a connection pin being arranged on the other side wall;

an iron core set assembled with the bobbin;

at least one movable pin including a first latch portion and a second latch portion, the movable pin being movably disposed in the through hole, the second latch portion is disposed above the first latch portion, the movable pin is disposed on one side of the iron core set, the first latch portion is a first pattern formed on the movable pin, and the second latch portion is a second pattern formed on the movable pin, the largest width of the first pattern is larger than a diameter of the through hole, and the largest width of the second pattern is larger than the diameter of the through hole;

at least one first winding wound around the winding portion and electrically connected to the connection pin; and at least one second winding wound around the winding portion and electrically connected to the movable pin, wherein the movable pin is selectively positioned at one of an upper position and a lower position, the movable pin is positioned at the upper position by tightly fitting the first pattern in the through hole for allowing the iron core set to be assembled with the bobbin or for allowing the first winding and the second winding to be wound onto the winding portion, and the movable pin is positioned at the lower position by tightly fitting the second pattern in the through hole when the transformer is installed onto the adapter.

11. The transformer according to claim 10, wherein a channel communicating with an inside of the winding portion passes through the two side walls, the channel is arranged below the protruding plate, a portion of the iron core set is inserted and engaged inside the channel, and another portion of the iron core set surrounds the exterior of the winding portion.

12. The transformer according to claim 10, wherein a wiring groove is disposed on a top of the protruding plate and arranged in a direction from the winding portion toward the through hole, two guiding blocks extend from the top of the protruding plate, and the wiring groove is formed between the two guiding blocks.

13. The transformer according to claim 10, wherein the first pattern and the second pattern are respectively made by punching on parts of a lateral surface of the movable pin to cause protruding deformation at other adjacent parts of the lateral surface of the movable pin.

14. The transformer according to claim 10, wherein the first pattern and the second pattern are respective rough surfaces made by texture process.

15. The transformer according to claim 10, wherein an insulation cover at least partially wraps the iron core set.

16. The transformer according to claim 15, wherein a stopping block is protrusively disposed on an external lateral surface of the insulation cover for positioning the transformer.

17. A transformer, suitable for an adapter, the transformer comprising:

a bobbin including a first side wall, a second side wall, and a winding portion arranged between the first side wall and the second side wall, a first protruding plate extending from the first side wall, a second protruding plate extending from the second side wall, a first through hole being defined on the first protruding plate, a second through hole being defined on the second protruding plate;

an iron core set assembled with the bobbin;

a first movable pin including a first latch portion and a second latch portion, the first movable pin being movably disposed in the first through hole, the second latch portion is disposed above the first latch portion, the first movable pin is disposed on one side of the iron core set, the first latch portion is a first pattern formed on the first movable pin, and the second latch portion is a second pattern formed on the first movable pin, the largest width of the first pattern is larger than a diameter of the first through hole, and the largest width of the second pattern is larger than the diameter of the first through hole;

a second movable pin including a third latch portion and a fourth latch portion, the second movable pin being movably disposed in the second through hole, the fourth latch portion is disposed above the third latch portion, the second movable pin is disposed on another side of the iron core set, the third latch portion is a third pattern formed on the second movable pin, and the fourth latch portion is a fourth pattern formed on the second movable pin, the largest width of the third pattern is larger than a diameter of the second through hole, and the largest width of the fourth pattern is larger than the diameter of the second through hole;

a first winding wound around the winding portion and electrically connected to the first movable pin; and a second winding wound around the winding portion and electrically connected to the second movable pin, wherein the first movable pin is selectively positioned at one of an upper position and a lower position, the first movable pin is positioned at the upper position by tightly fitting the first pattern in the first through hole for allowing the iron core set to be assembled with the bobbin or for allowing the first winding and the second winding to be wound onto the winding portion, and the first movable pin is positioned at the lower position by tightly fitting the second pattern in the first through hole when the transformer is installed onto the adapter, and the second movable pin is selectively positioned at one of an upper position and a lower position, the second movable pin is positioned at the upper position by tightly fitting the third pattern in the second through hole for allowing the iron core set to be assembled with the bobbin or for allowing the first winding and the second winding to be wound onto the winding portion, and the second movable pin is positioned at the lower position by tightly fitting the fourth pattern in the second through hole when the transformer is installed onto the adapter.

* * * * *